US006237915B1

(12) United States Patent
Ledet et al.

(10) Patent No.: US 6,237,915 B1
(45) Date of Patent: May 29, 2001

(54) BOARD GAME FOR TEACHING PROJECT MANAGEMENT SKILLS

(75) Inventors: Michelle R. Ledet; Winston J. Ledet; Spiro M. Maroulis; Winston P. Ledet, all of Humble, TX (US)

(73) Assignee: Practice Fields L.L.C., Humble, TX (US)

( * ) Notice: Subject to any disclaimer, the term of this patent is extended or adjusted under 35 U.S.C. 154(b) by 0 days.

(21) Appl. No.: 09/345,436

(22) Filed: Jun. 30, 1999

(51) Int. Cl.[7] ..... A63F 3/00

(52) U.S. Cl. ..... 273/236; 273/287; 273/256; 273/278

(58) Field of Search ..... 273/256, 235, 273/278, 287, FOR 236, 213

(56) References Cited

U.S. PATENT DOCUMENTS

| | | | |
|---|---|---|---|
| 3,737,167 | | 6/1973 | Kelley . |
| 3,765,682 | | 10/1973 | Braude . |
| 3,850,433 | | 11/1974 | Purlia . |
| 4,095,799 | | 6/1978 | Stringer . |
| 4,150,827 | | 4/1979 | Barnett . |
| 4,289,313 | * | 9/1981 | Delamontagne . |
| 4,354,684 | | 10/1982 | McKinley . |
| 4,363,628 | | 12/1982 | Kirkpatrick et al. . |
| 4,386,778 | * | 6/1983 | Hall . |
| 4,484,748 | * | 11/1984 | Becze . |
| 4,856,788 | | 8/1989 | Fischel . |
| 5,071,135 | | 12/1991 | Campbell . |
| 5,207,792 | | 5/1993 | Anderson . |
| 5,456,473 | | 10/1995 | Whitney . |
| 5,673,915 | | 10/1997 | Shalders . |
| 5,826,878 | | 10/1998 | Kiyosaki et al. . |
| 5,876,035 | | 3/1999 | Medina, Jr. . |
| 5,887,871 | | 3/1999 | Zappolo . |

* cited by examiner

*Primary Examiner*—Benjamin H. Layno
*Assistant Examiner*—Vishu K. Mendiratta
(74) *Attorney, Agent, or Firm*—Rosenthal & Osha L.L.P.

(57) ABSTRACT

A game for teaching project management skills is disclosed. The game includes a play space having an area to track progress of tasks from a predetermined group of tasks which upon completion constitutes a game project. The project tasks when completed constitute completion of a game project. The game includes indicators for work effort for workers assigned to the project tasks by the players, tracking project tasks, and project funds. The assigned workers incur corresponding amounts of project funds expenditure during each project period. The game includes first information indicators for each project task, each stating a minimum task completion time, a total work effort, project funds costs, and an inherent delay time for each task. The game includes second information indicators for identification and mitigation of a risk associated with selected ones of the tasks, each second indicator stating consequences comprising one of additional work effort to complete the task, delay in completing the task, additional task errors and expenditure of additional project funds on the task. The consequences are incurred on occurrence of a probabilistic event. The probability of the event occurring, and the magnitude of the consequences is related to whether the players have mitigated the risk. Occurrence of the first and second probabilistic events is determined by a random event generator.

32 Claims, 34 Drawing Sheets

| | | | | |
|---|---|---|---|---|
| FIG. 1-B | FIG. 1-F | FIG. 1-J | FIG. 1-N | FIG. 1-R |
| FIG. 1-C | FIG. 1-G | FIG. 1-K | FIG. 1-O | FIG. 1-S |
| FIG. 1-D | FIG. 1-H | FIG. 1-L | FIG. 1-P | FIG. 1-T |
| FIG. 1-E | FIG. 1-I | FIG. 1-M | FIG. 1-Q | FIG. 1-U |

FIG. 1-A

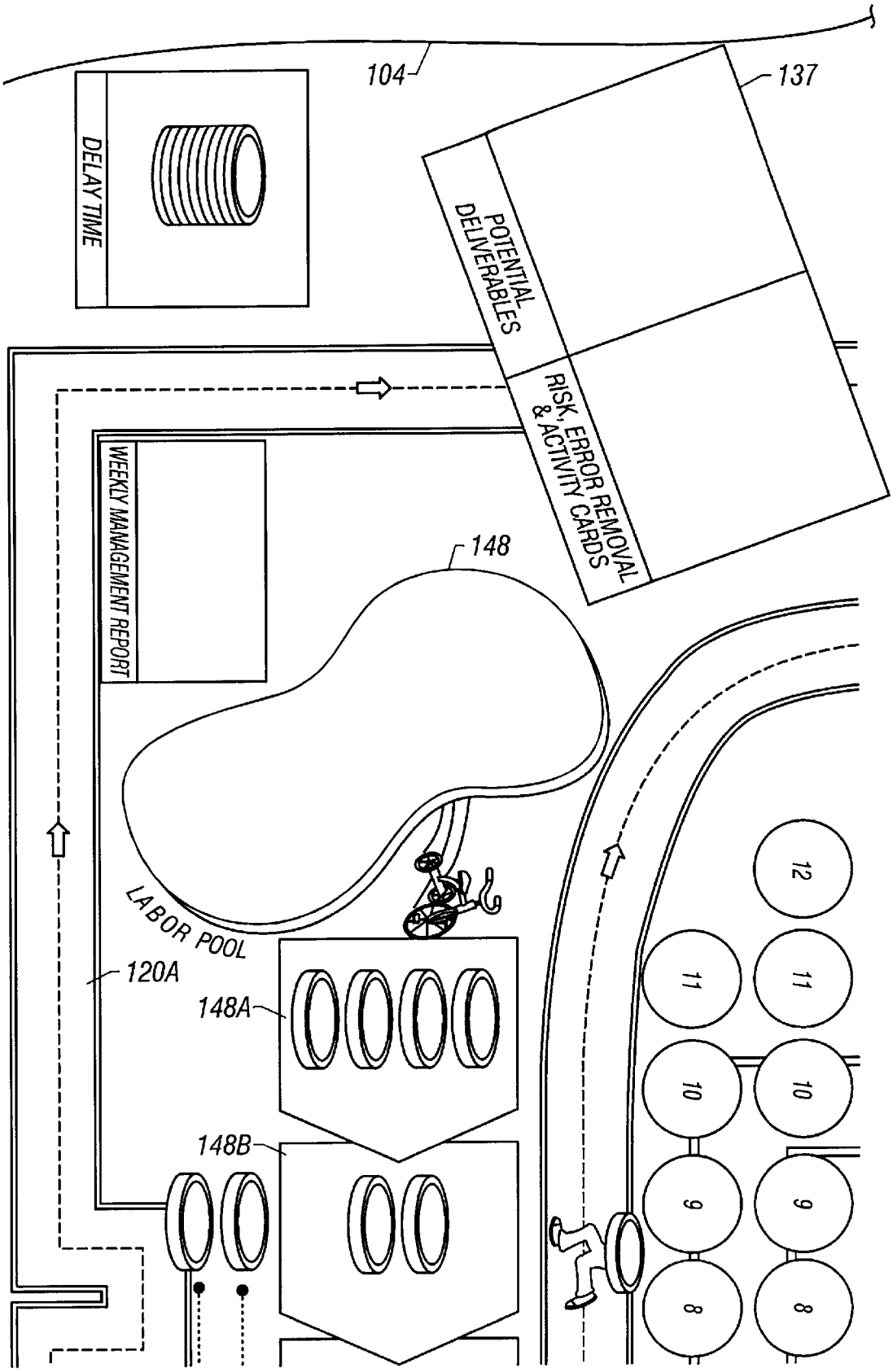
FIG. 1-B

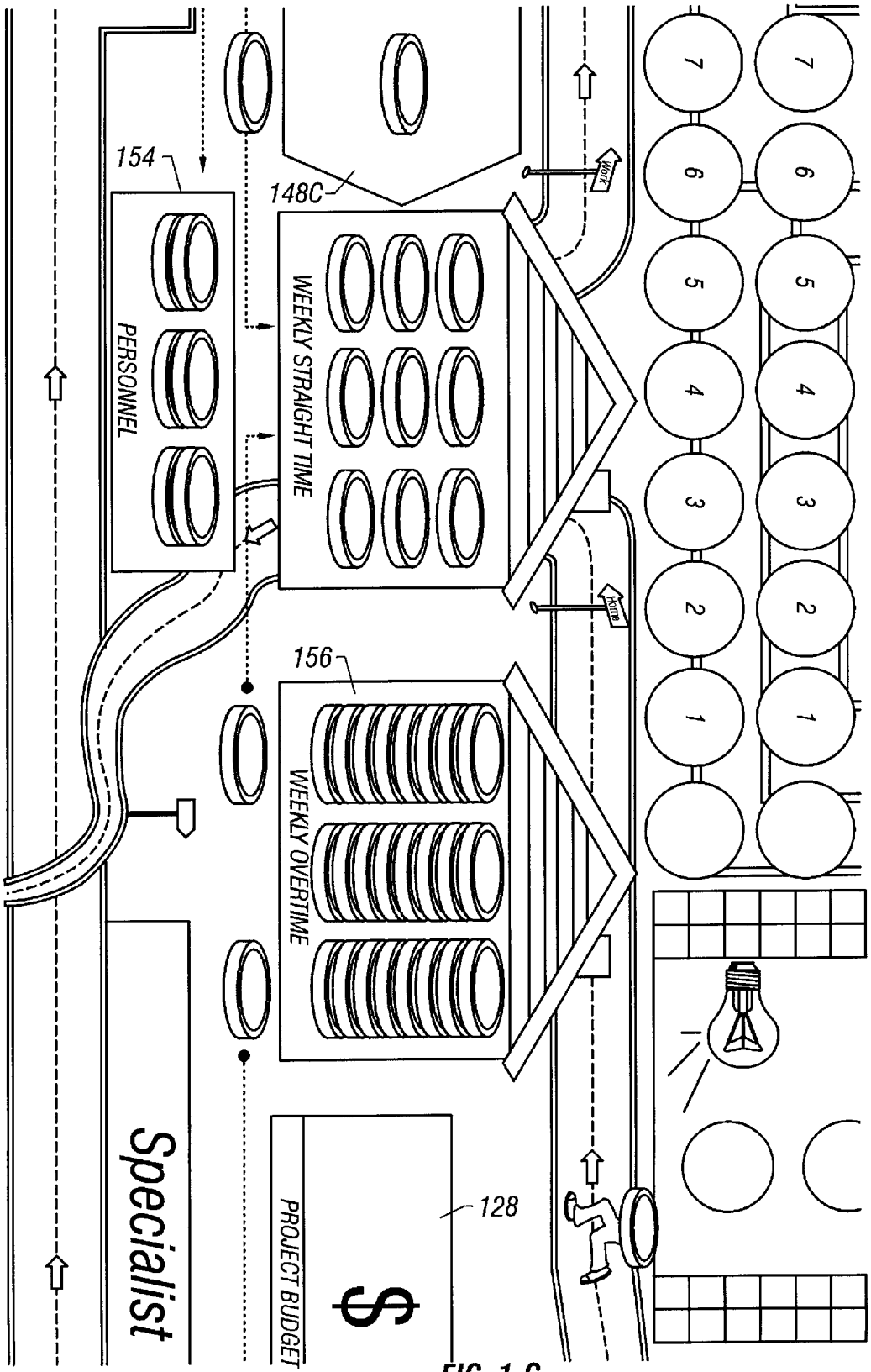
FIG. 1-C

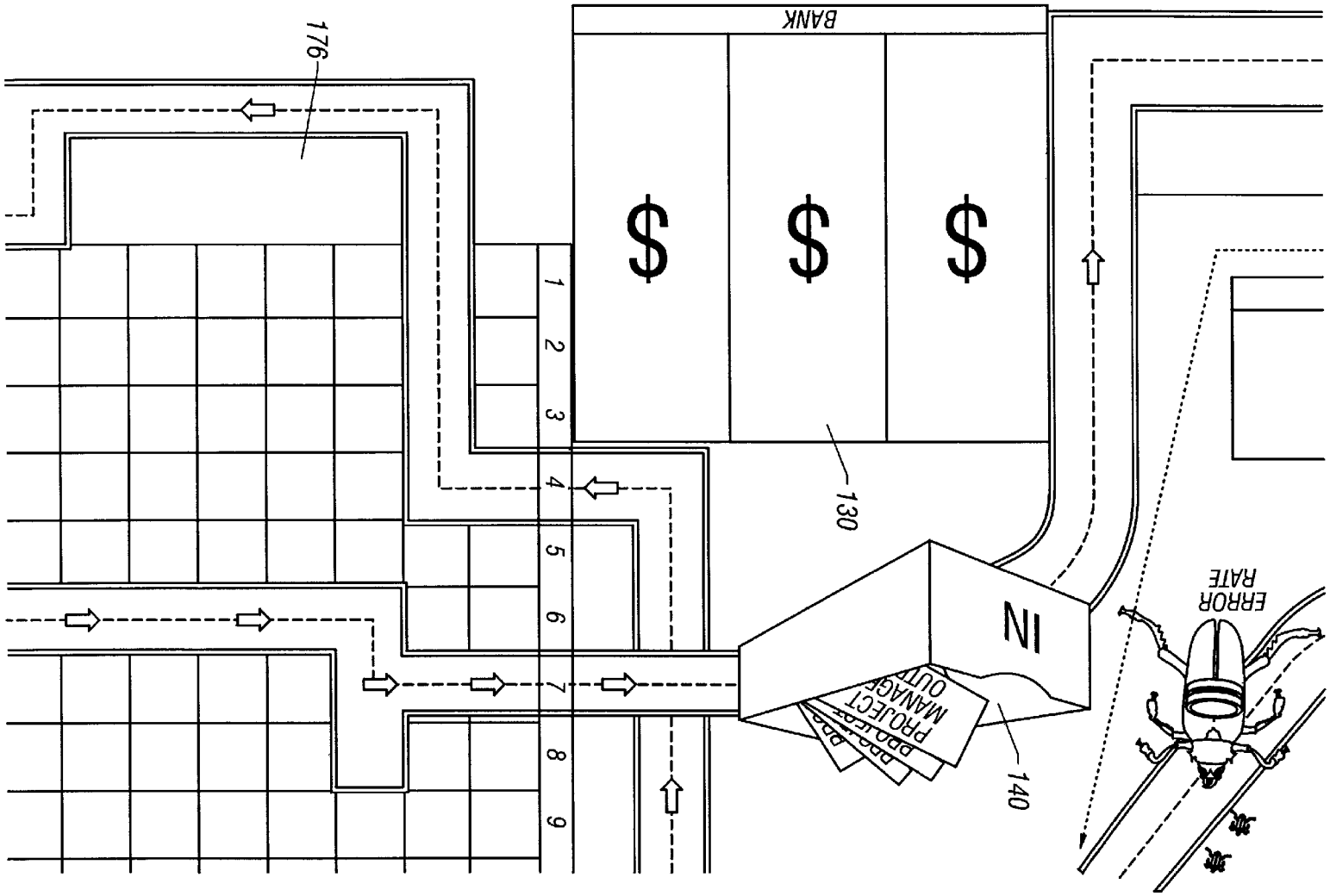
FIG. 1-D

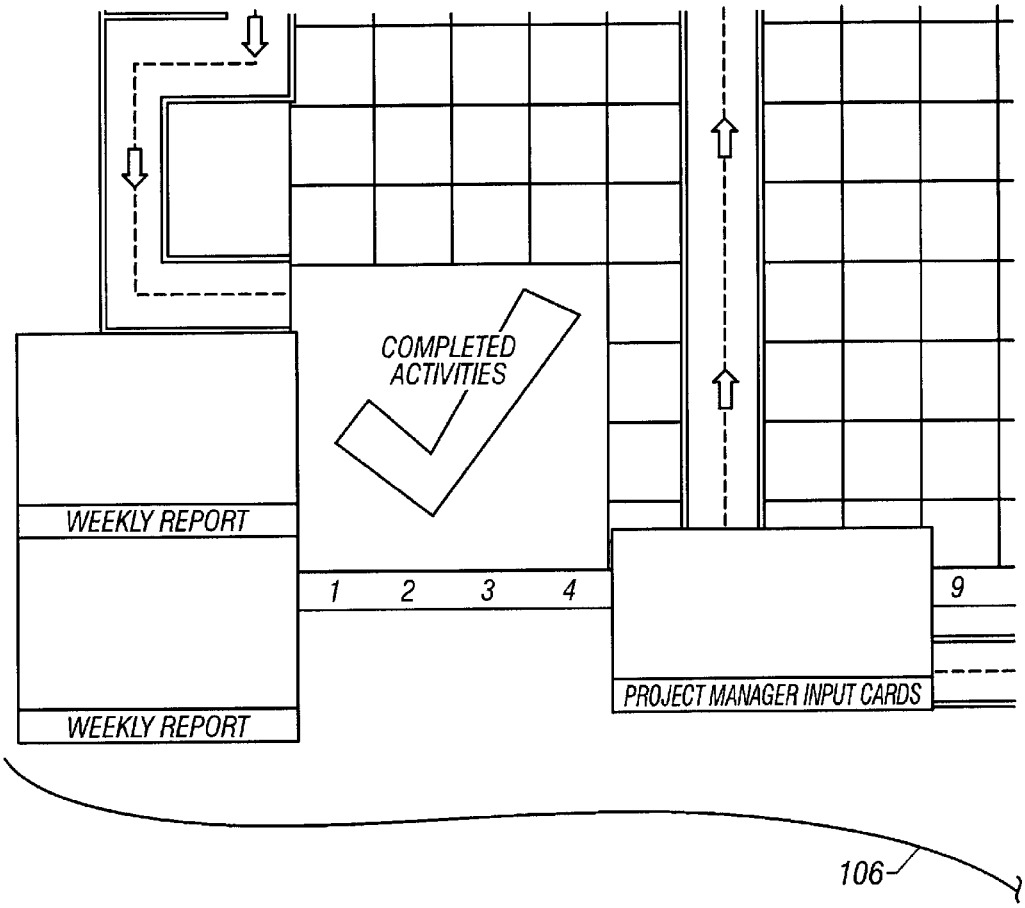
FIG. 1-E

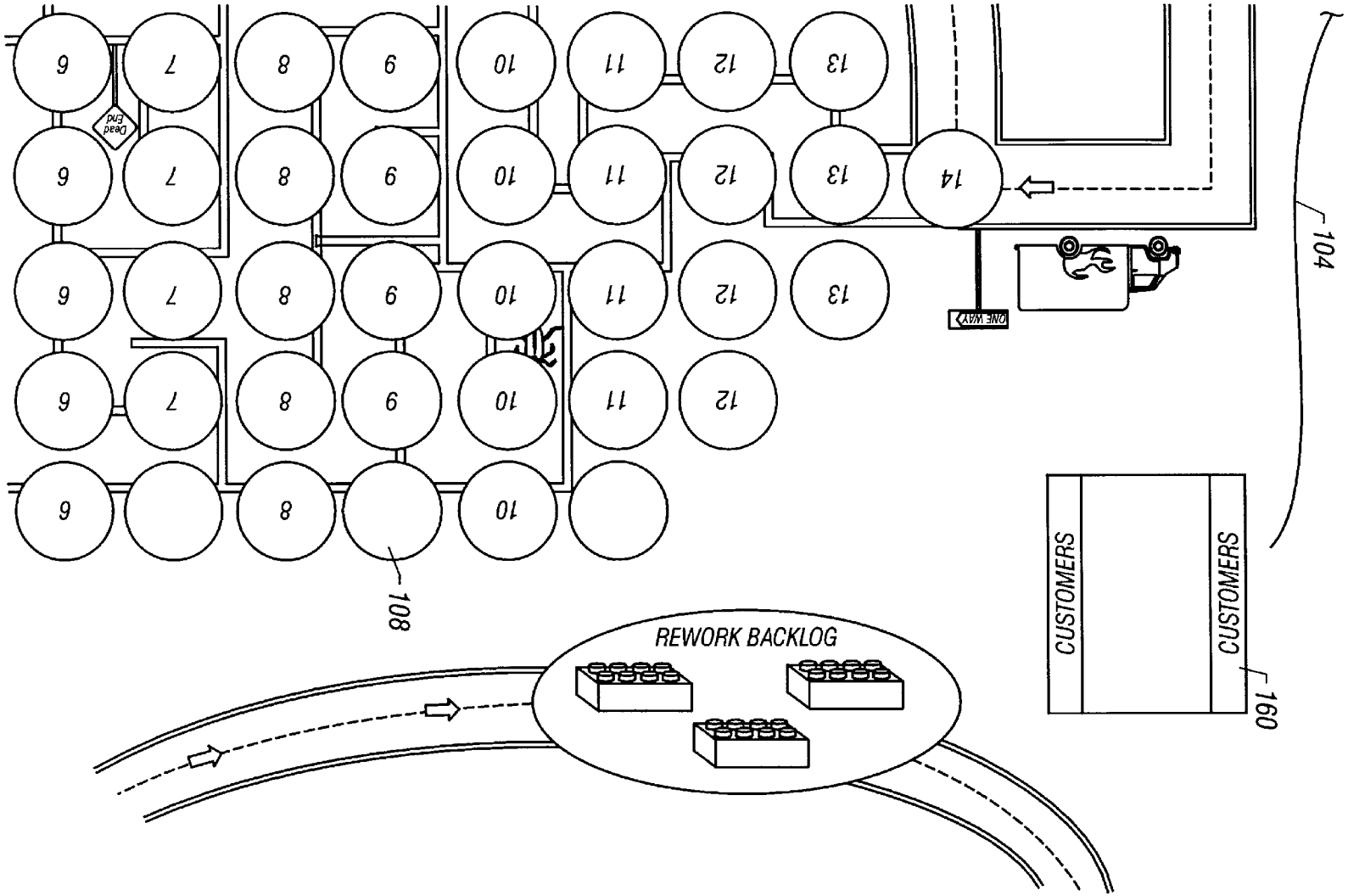
FIG. 1-F

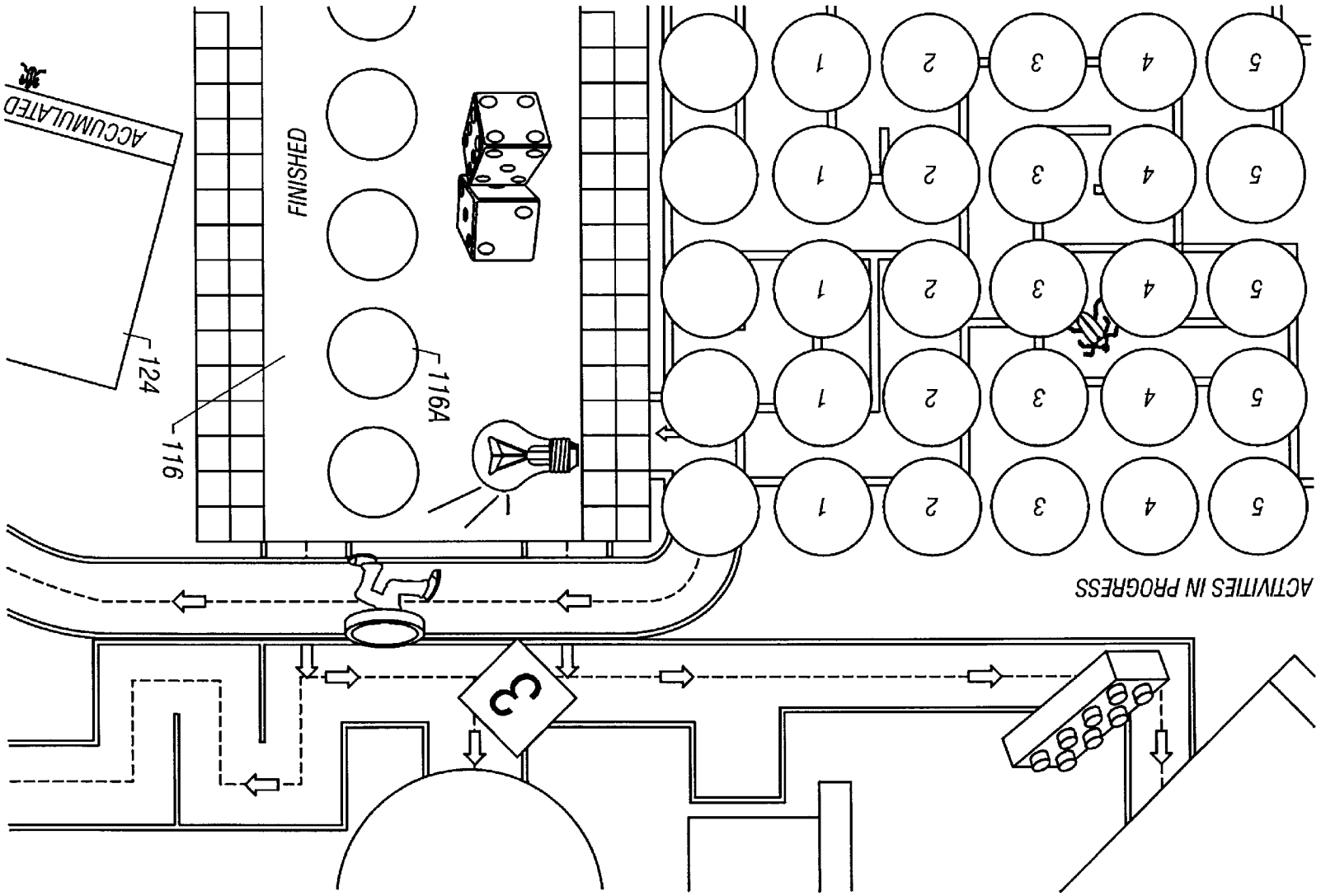
FIG. 1-G

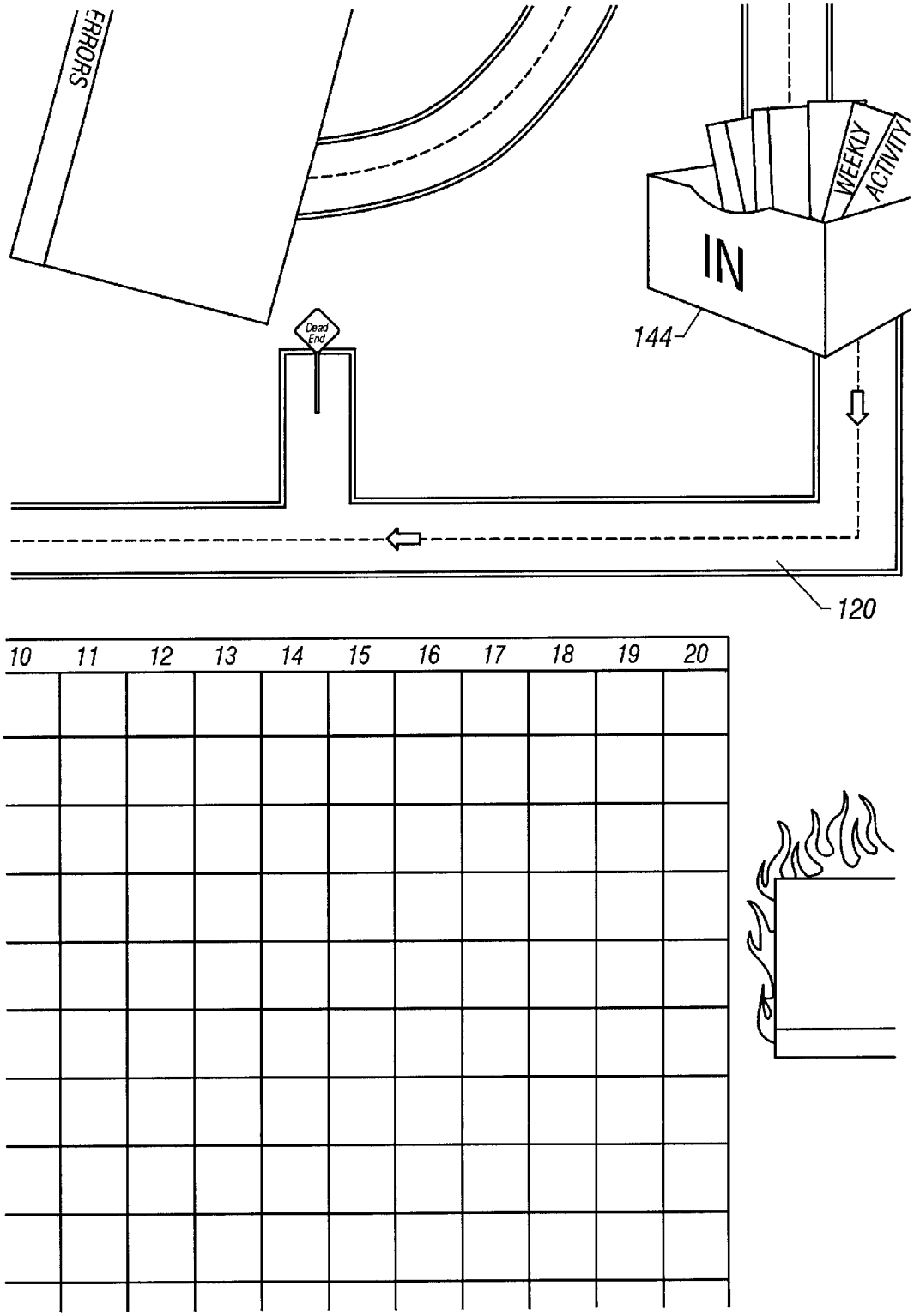
FIG. 1-H

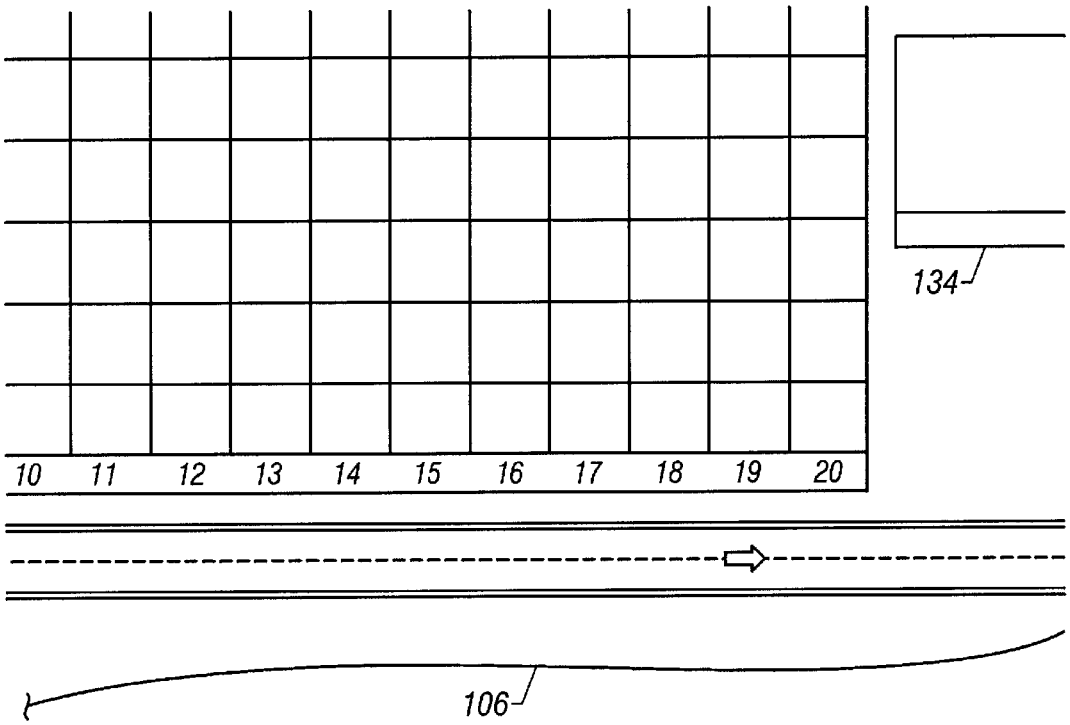
FIG. 1-I

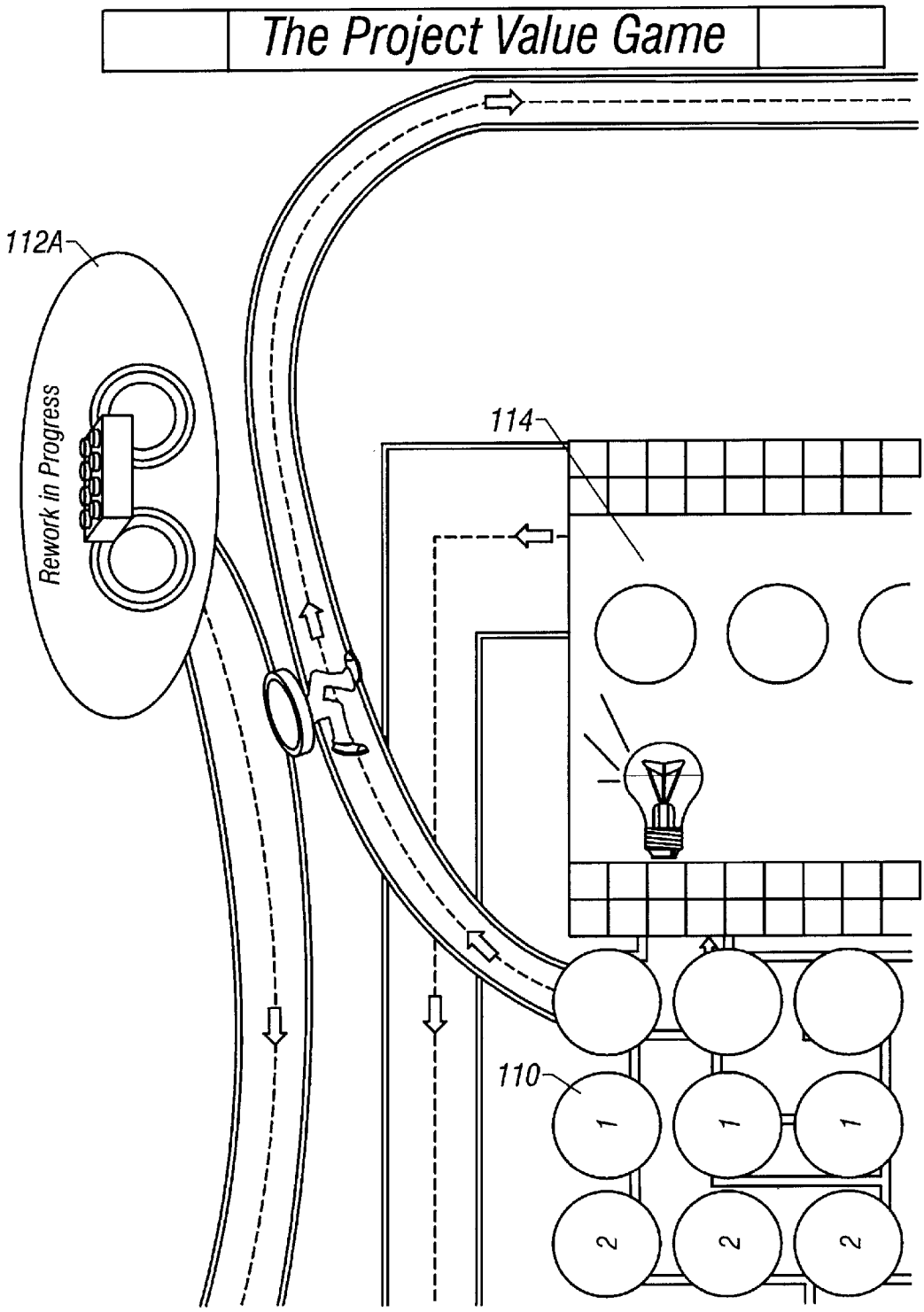
FIG. 1-J

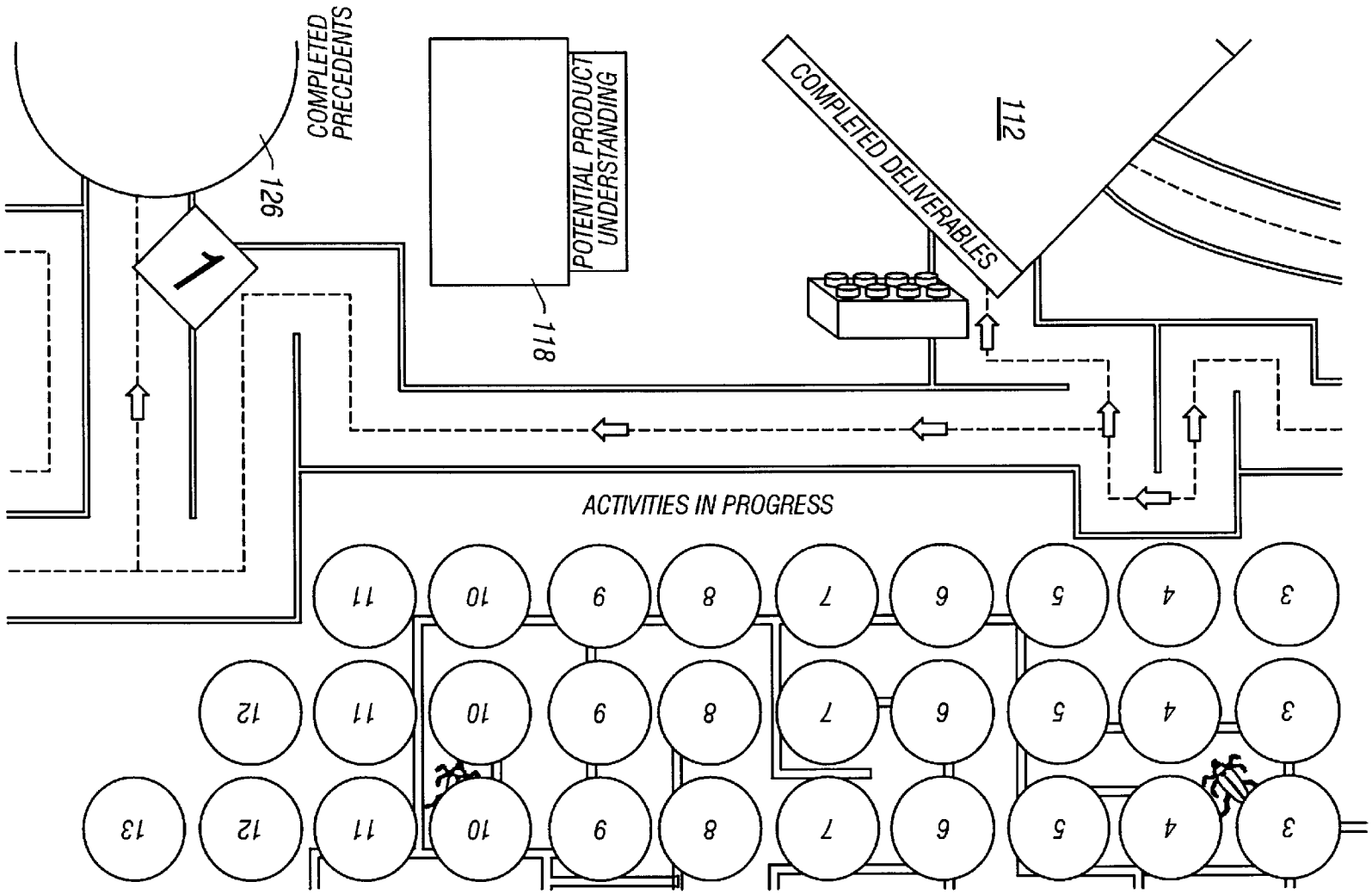
FIG. 1-K

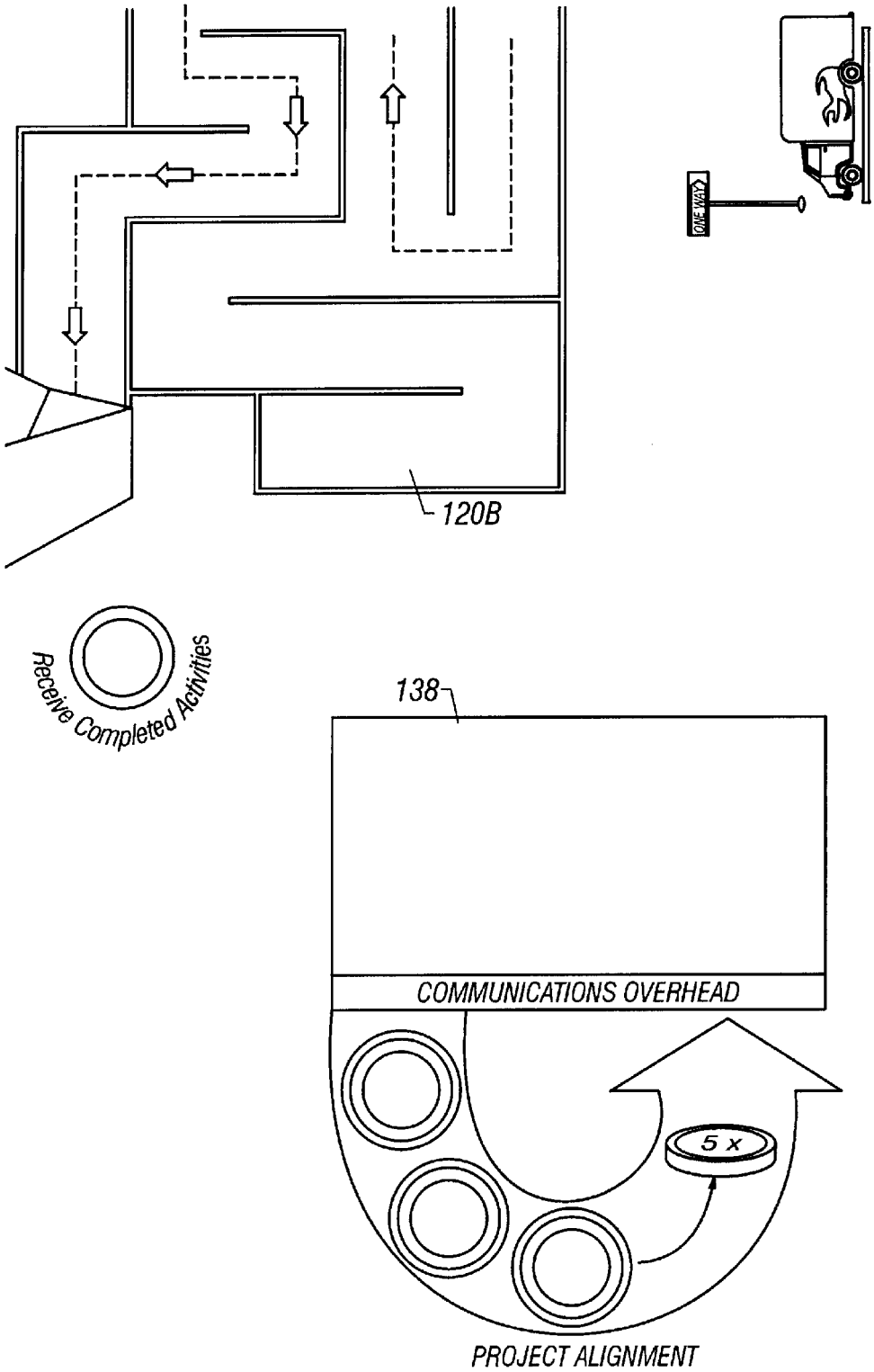
FIG. 1-L

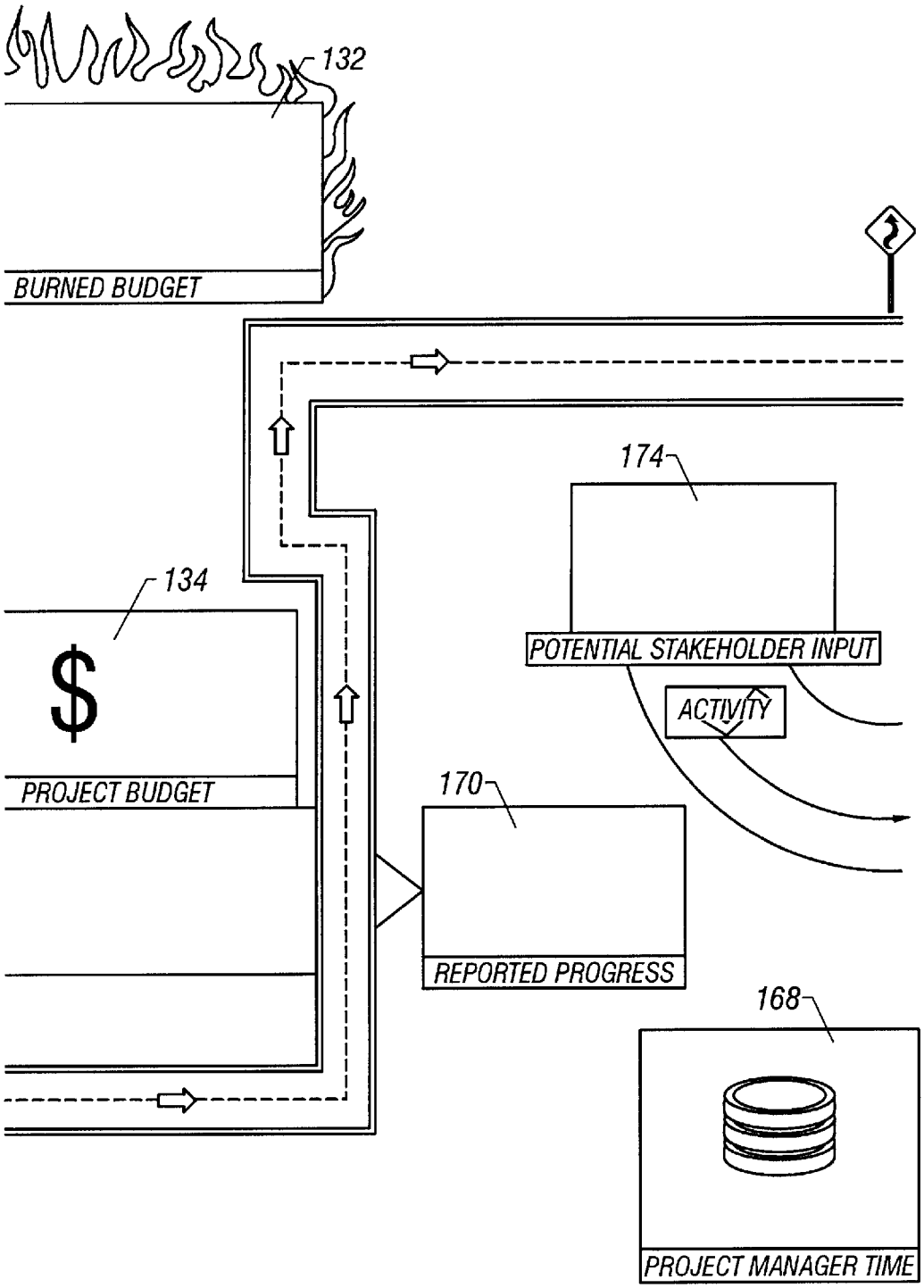
FIG. 1-M

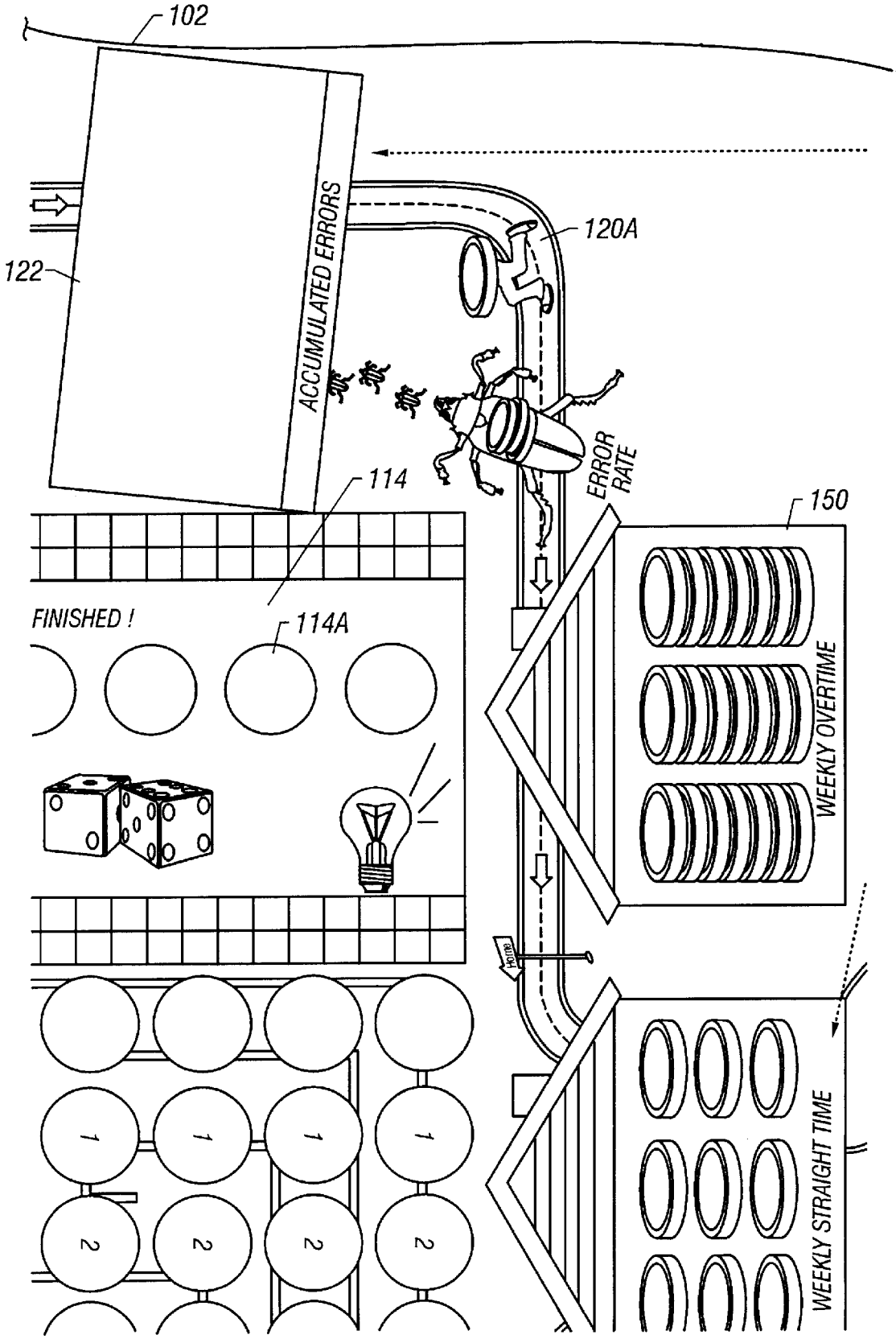
FIG. 1-N

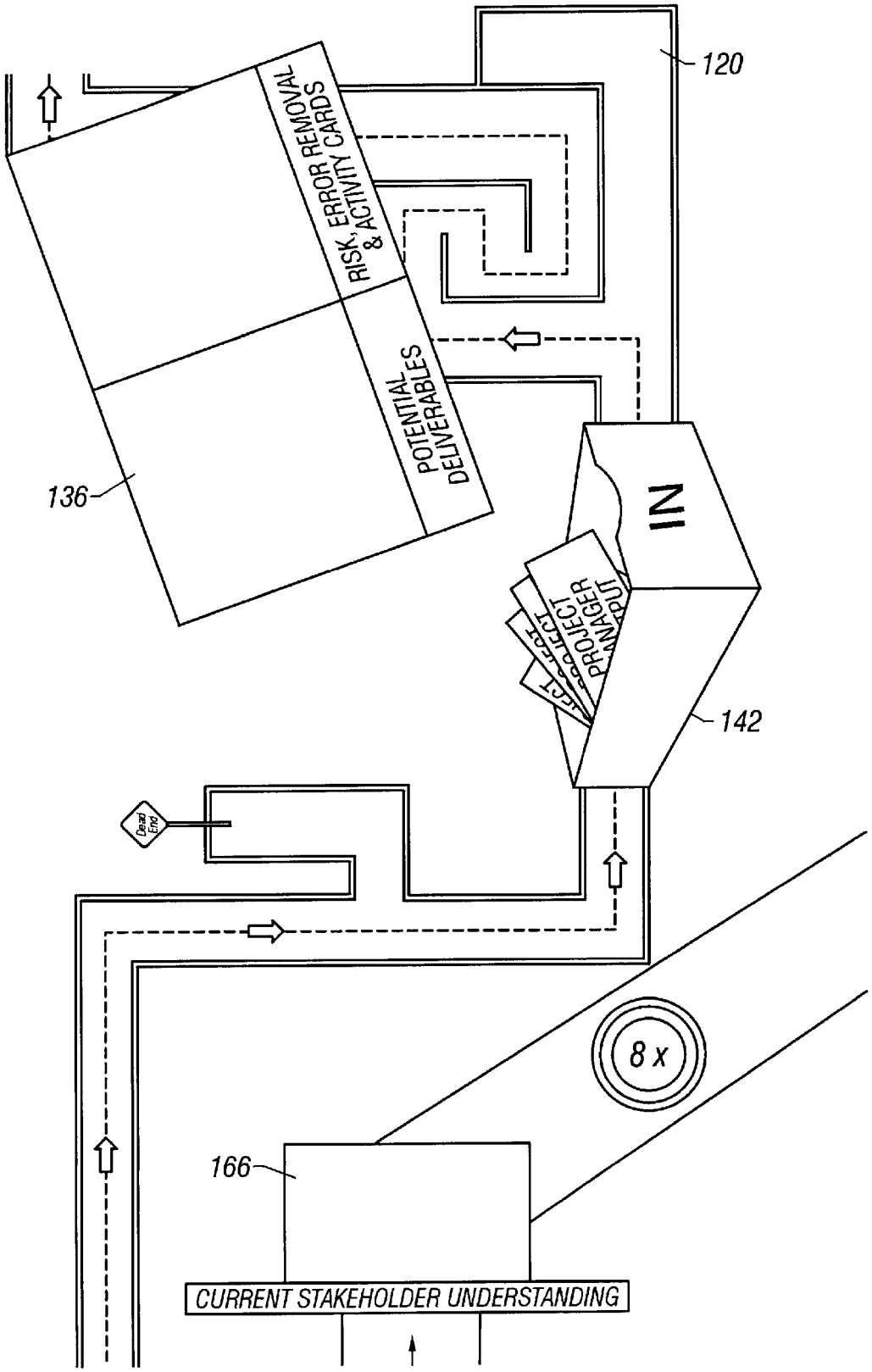
FIG. 1-P

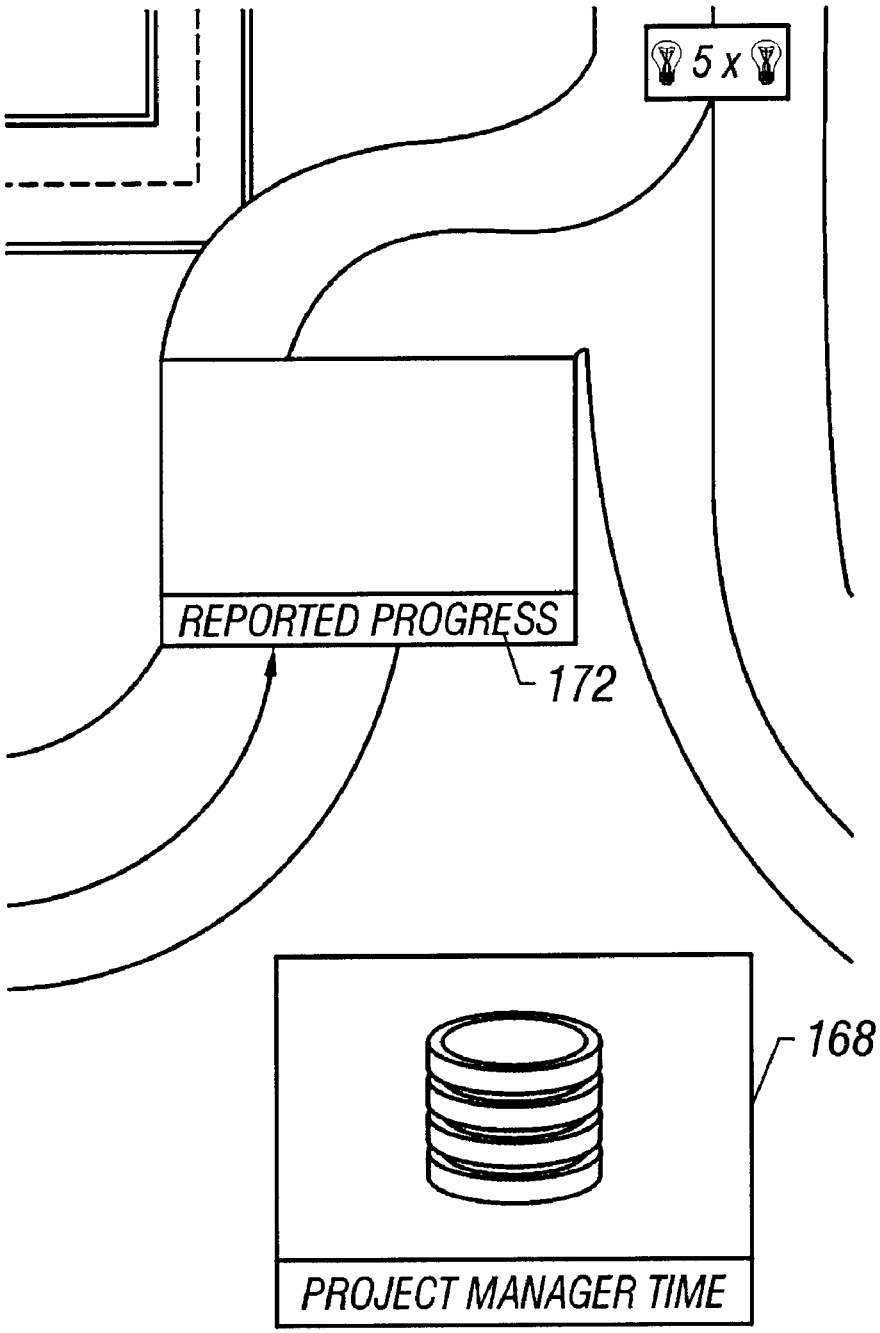
FIG. 1-Q

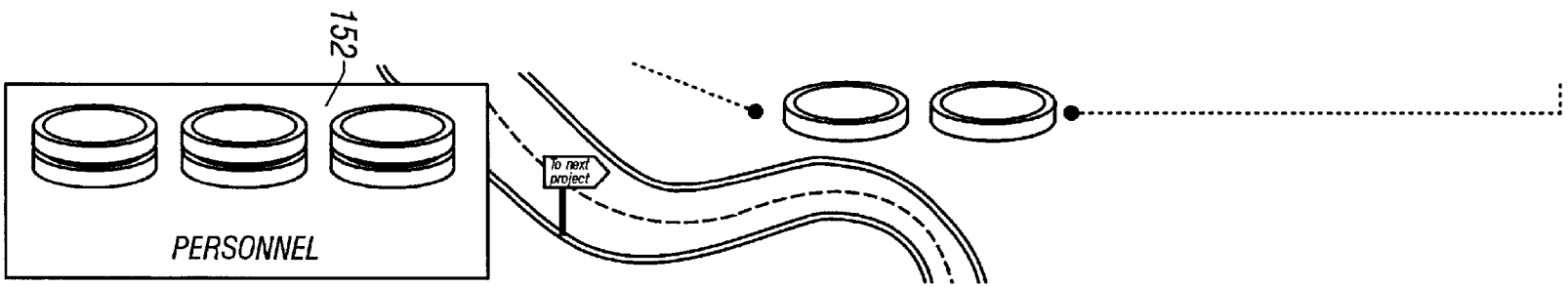
FIG. 1-R

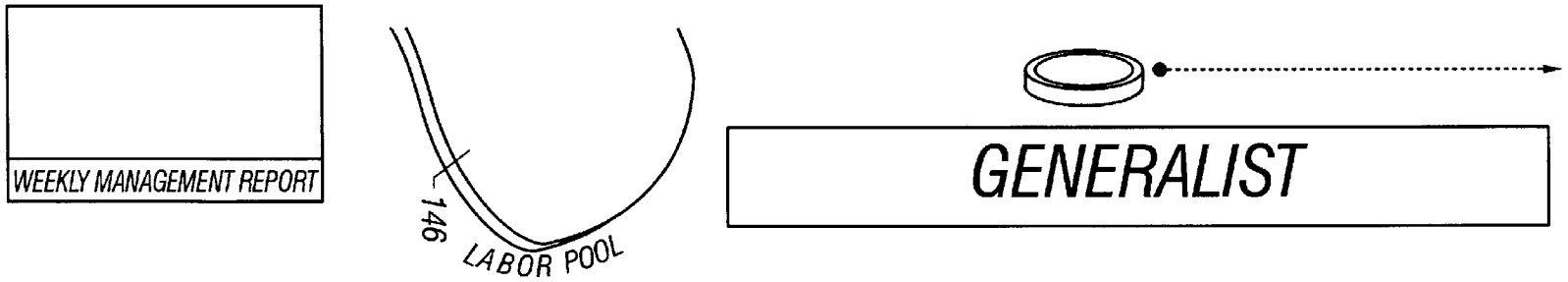
FIG. 1-S

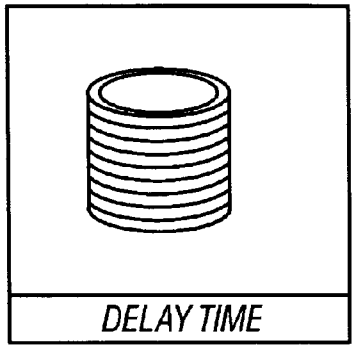
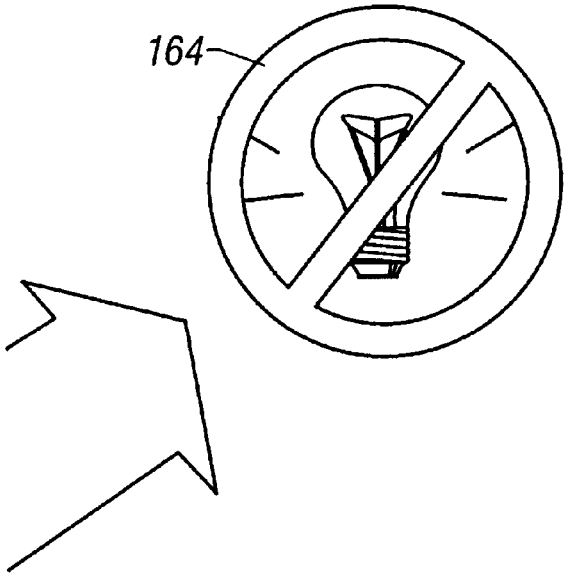
FIG. 1-T

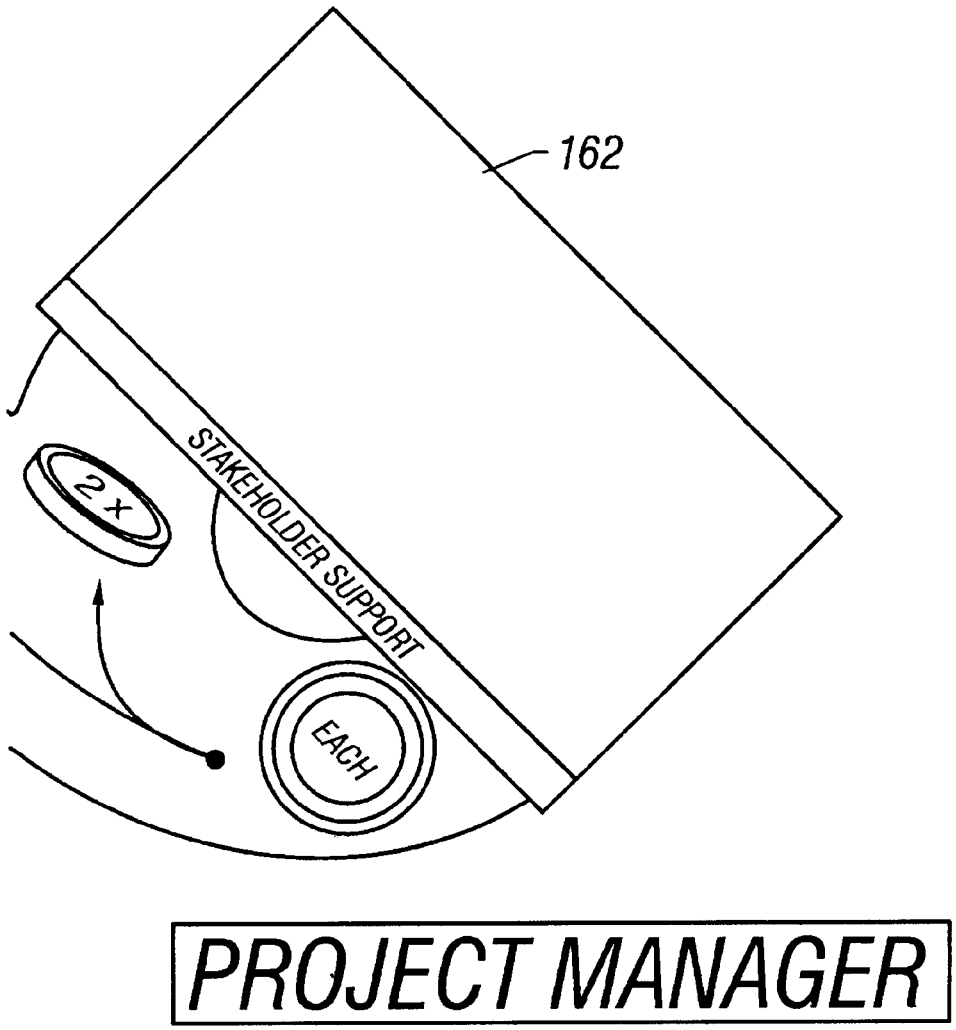
FIG. 1-U

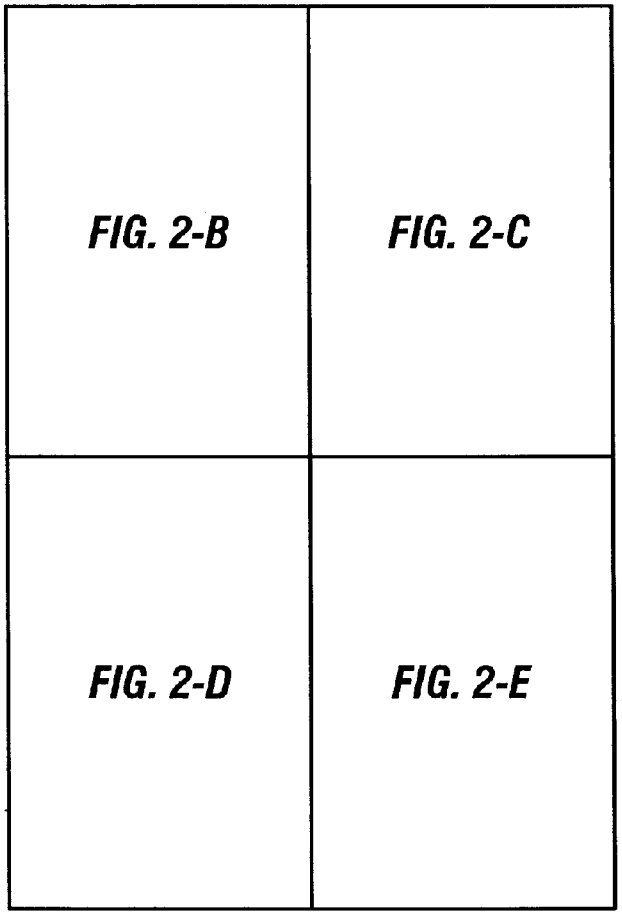
FIG. 2-A

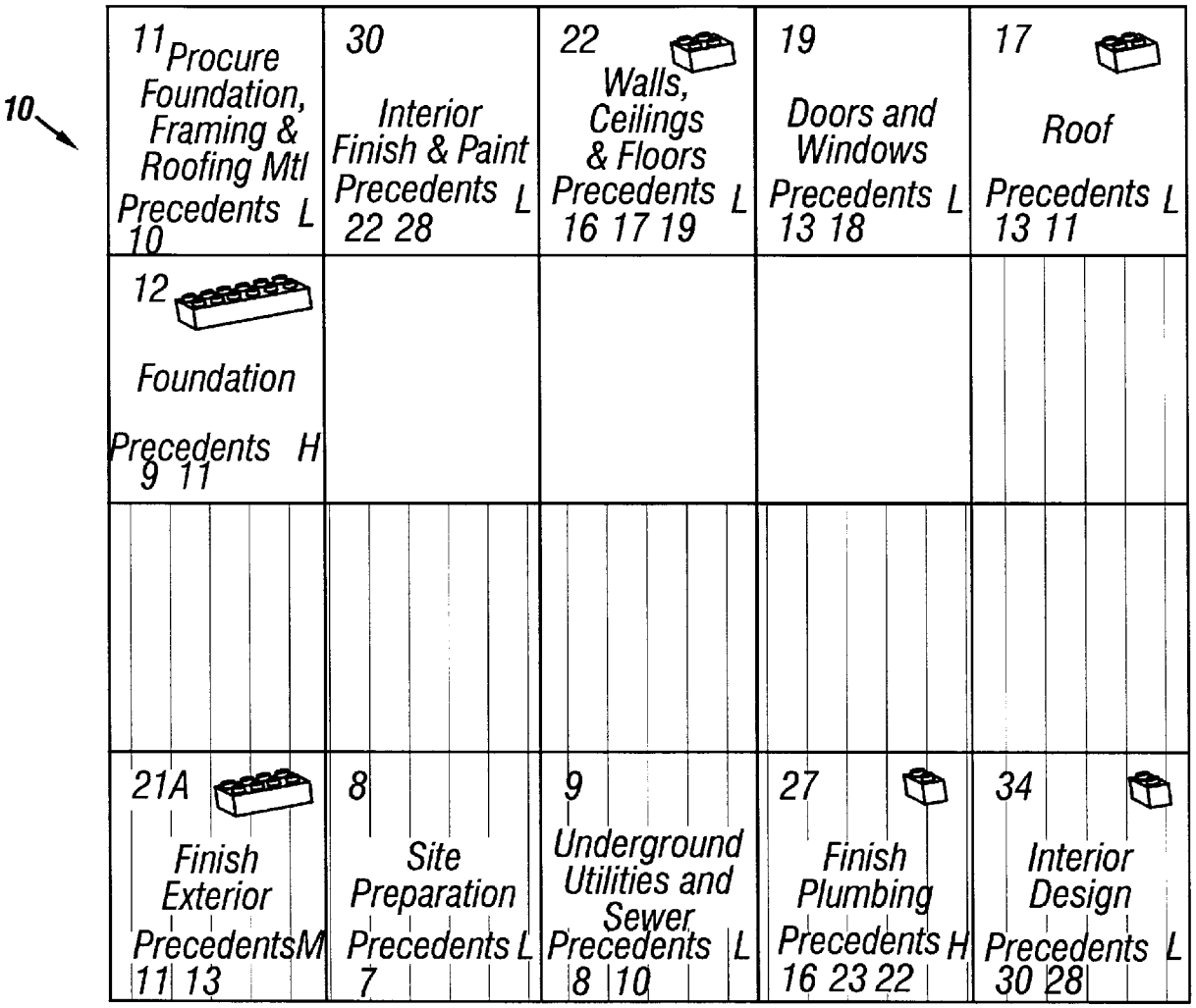
FIG. 2-B

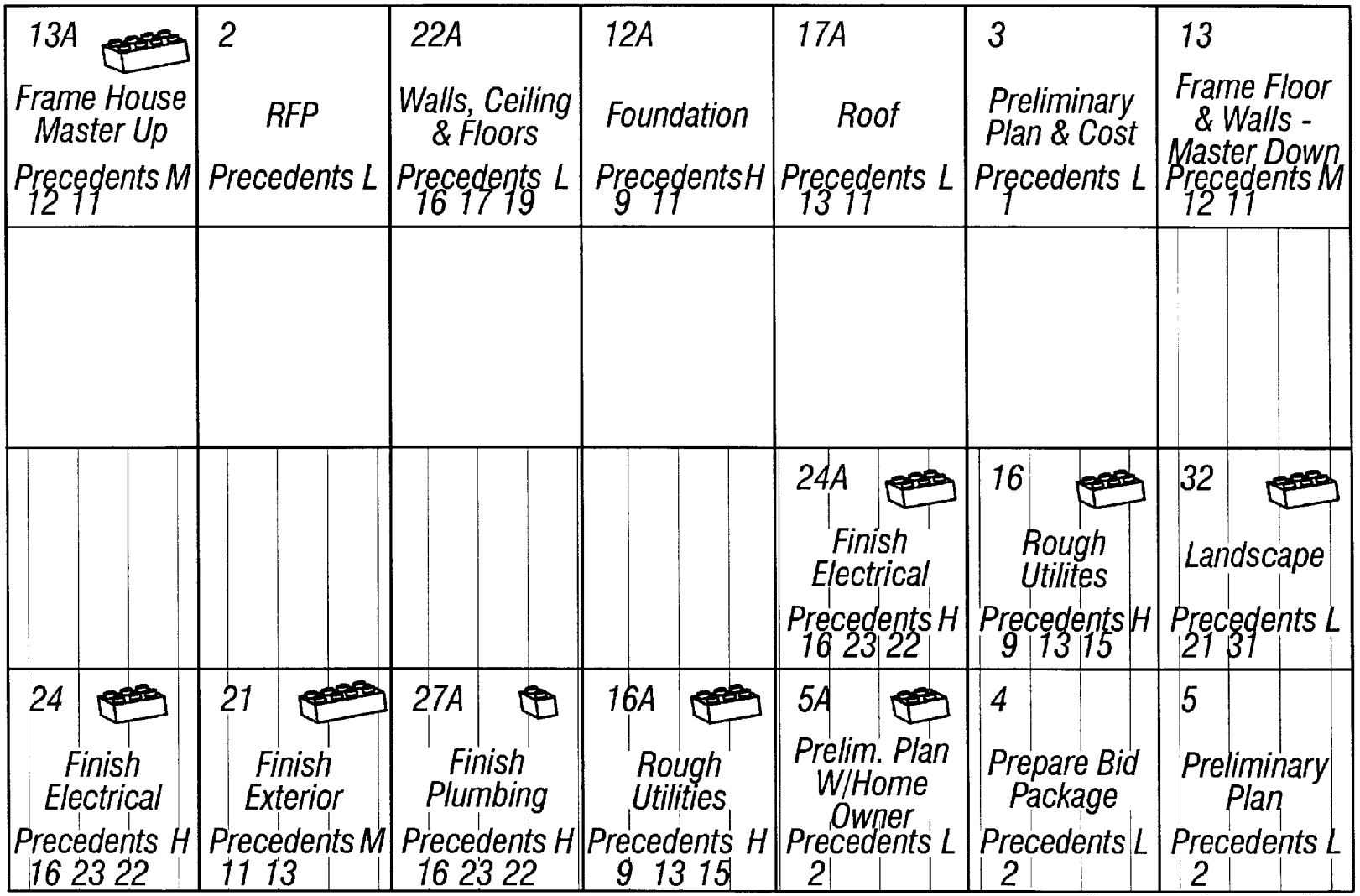
FIG. 2-C

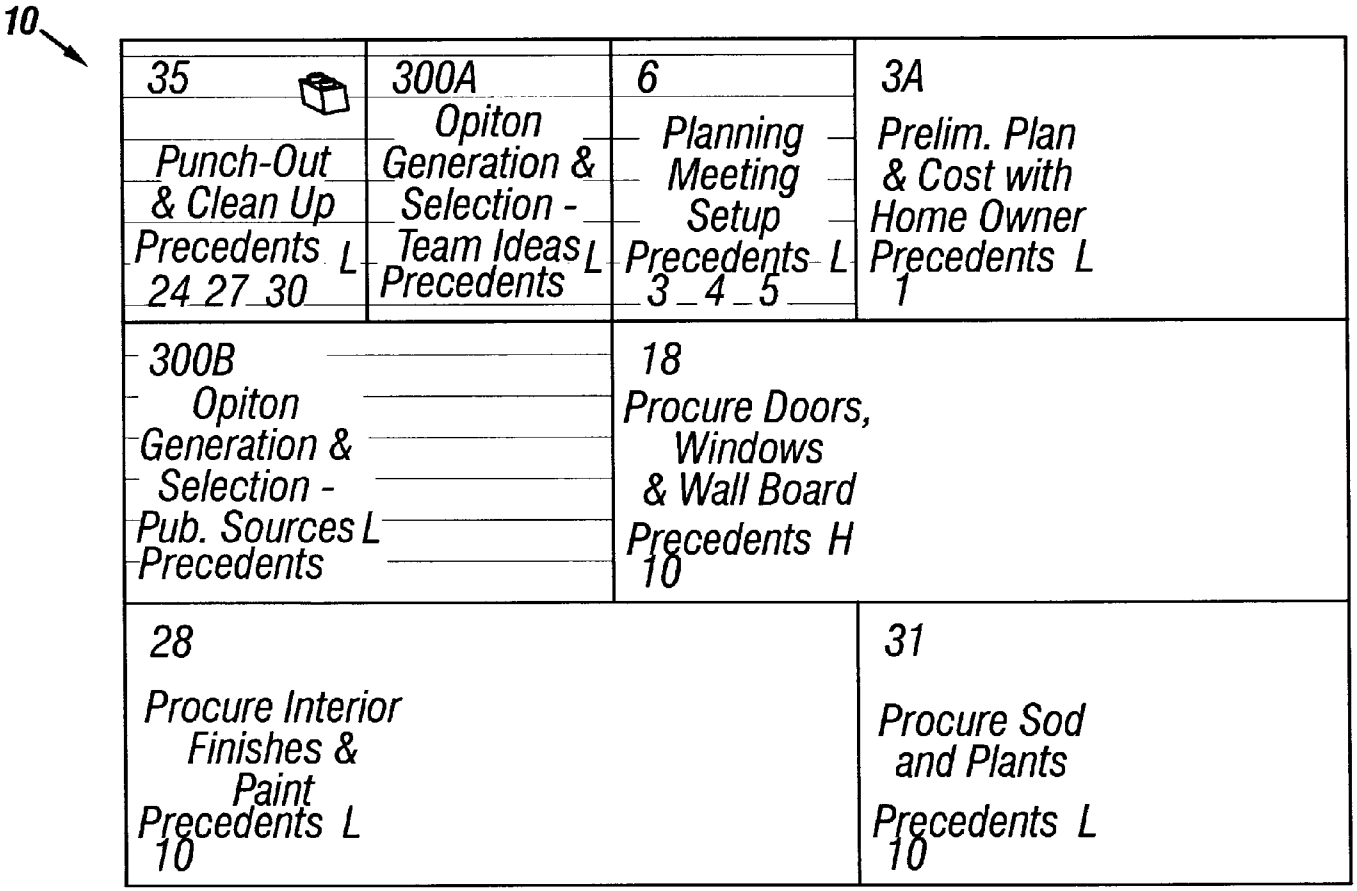
FIG. 2-D

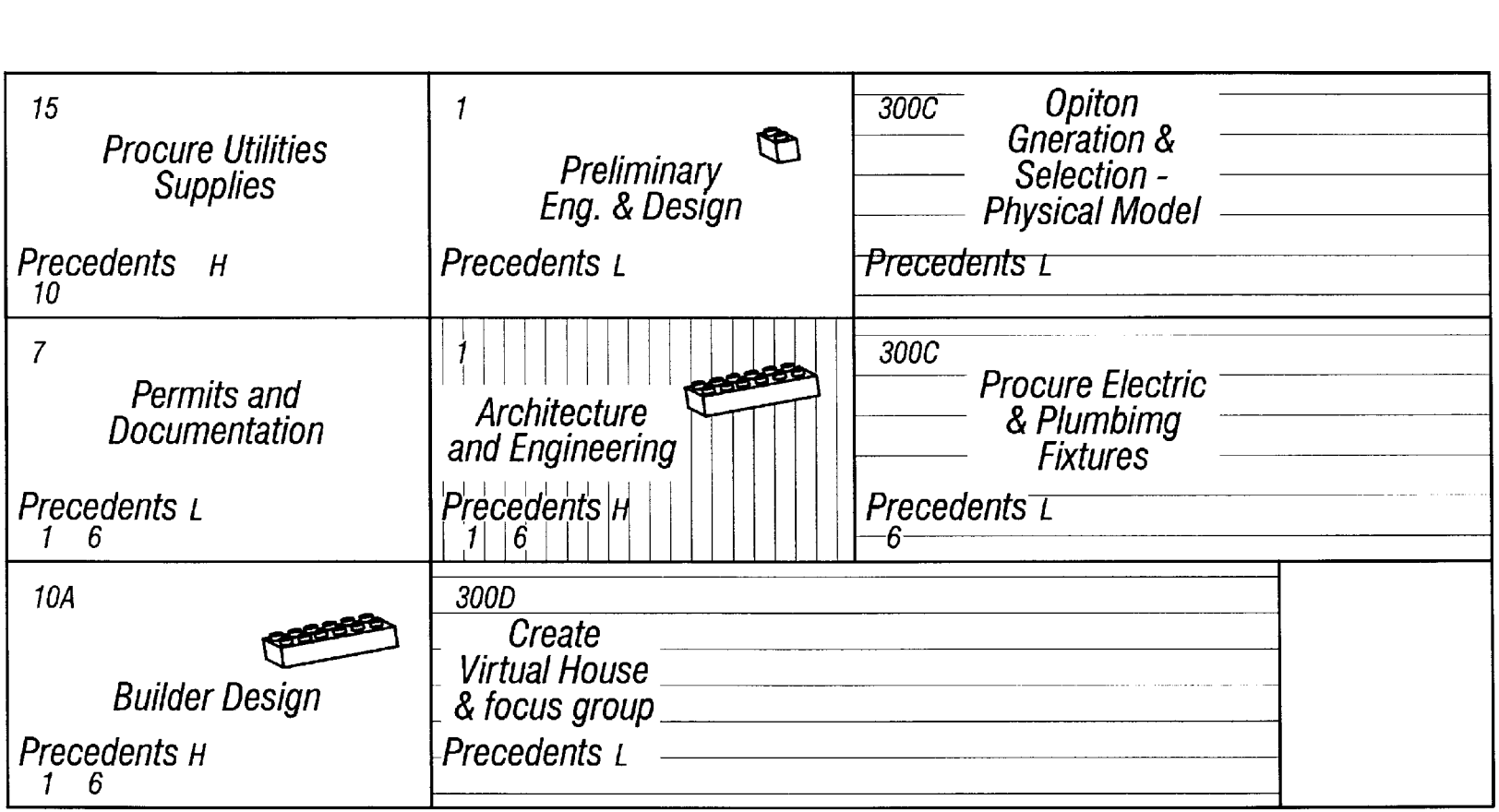
FIG. 2-E

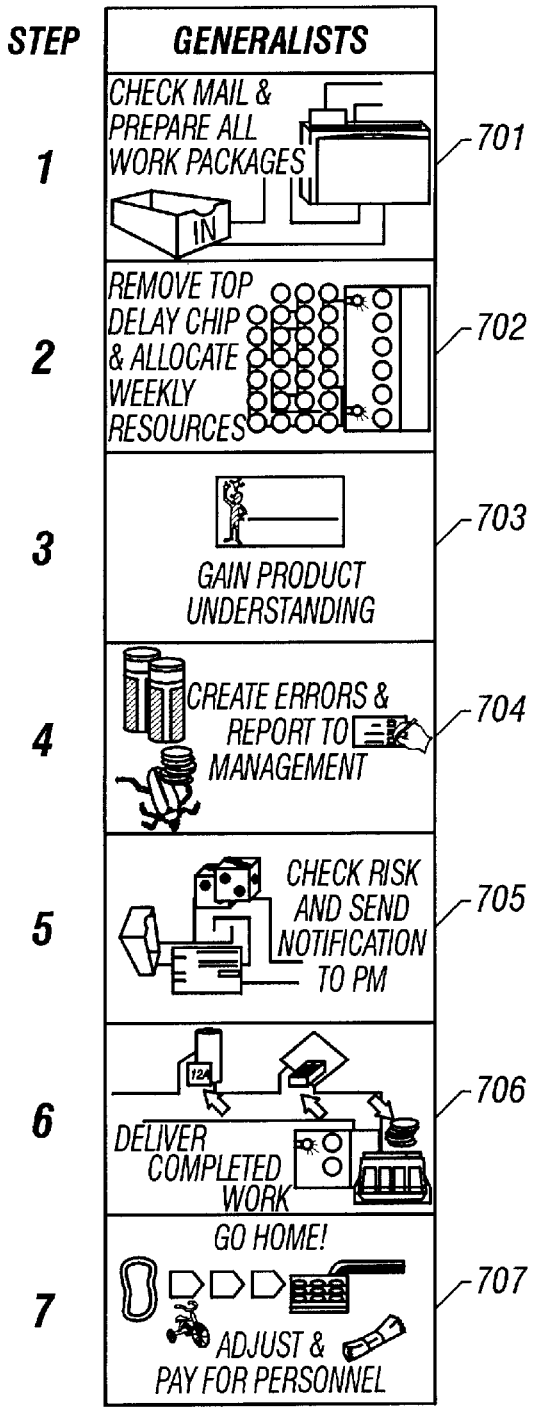
FIG 7-A
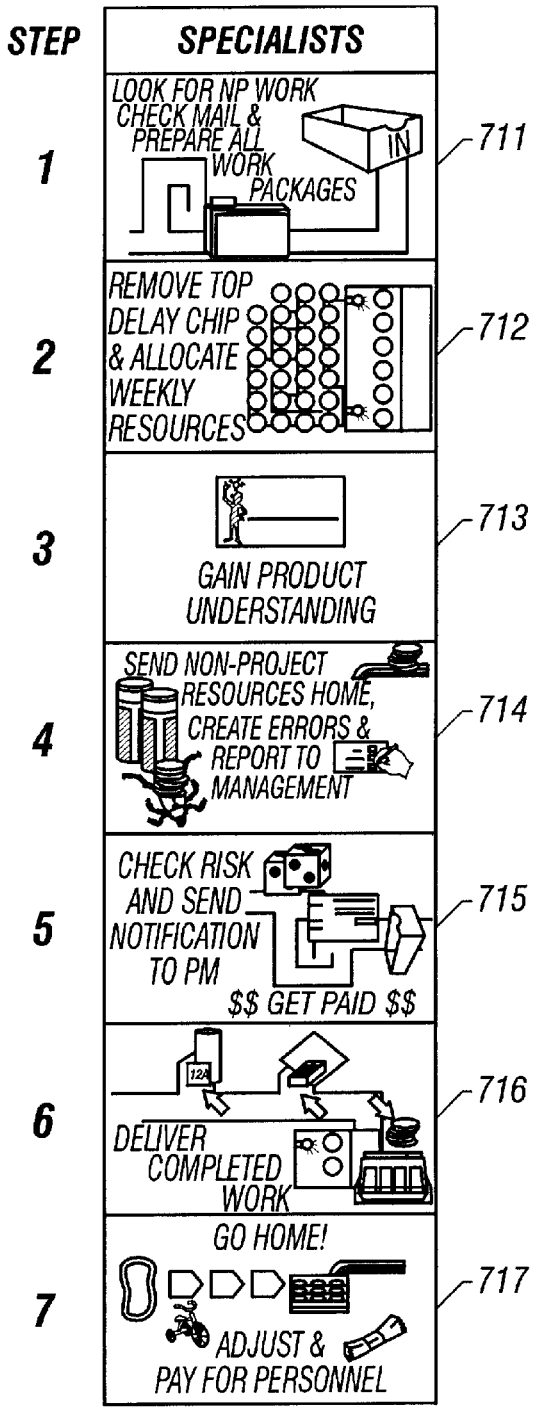
FIG 7-B

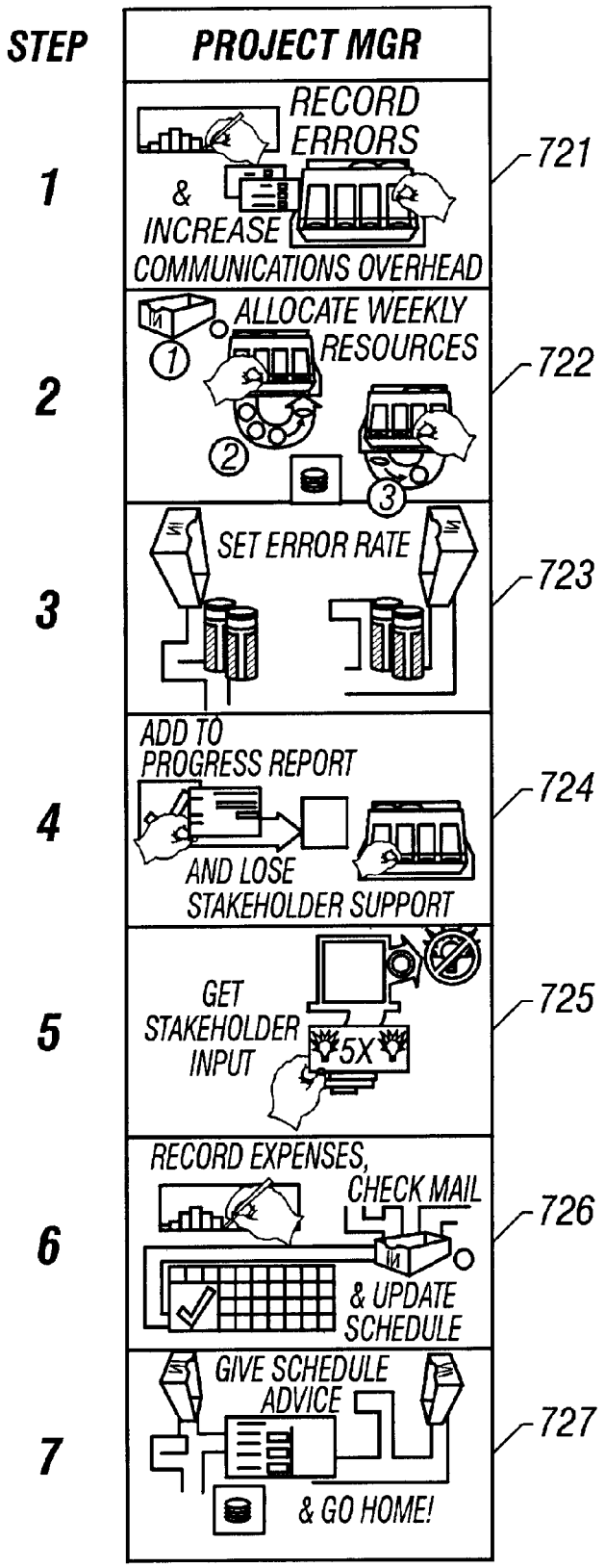
FIG 7-C

BOARD GAME FOR TEACHING PROJECT MANAGEMENT SKILLS

BACKGROUND OF THE INVENTION

1. Field of the Invention

The invention relates generally to the field of board games. More specifically, the invention relates to board games used to teach business management skills. More particularly, the invention is related to games used to teach project management skills 2. Description of the Related Art Board games have been used to teach various types of management skills, including business management and management of personal finances. For example, U.S. Pat. No. 3,737,167 issued to Kelley describes using a board game to teach personal decision-making skills. U.S. Pat. No. 3,765,682 issued to Braude describes using another board game to teach property investment management skills. U.S. Pat. No. 4,363,628 describes a board game used to train bank personnel. Still other games, such as described, for example, in U.S. Pat. No. 4,386,778 issued to Hall, U.S. Pat. No. 5,207,792 issued to Anderson, and U.S. Pat. No. 5,456,473 issued to Whitney are used to teach various aspects of the construction business.

Management skills teaching and business strategy teaching games are described, for example, in U.S. Pat. No. 4,354,684 issued to McKinley, U.S. Pat. No. 4,289,313 issued to Delamontagne, U.S. Pat. No. 5,071,135 issued to Campbell, U.S. Pat. No. 5,876,035 issued to Medina, Jr., U.S. Pat. No. 5,826,878 issued to Kiyosaki et al.

Although many different aspects of management skills teaching are covered by games known in the art, a particular set of management skills is not directly addressed by management teaching games known in the art. Specifically, prior art management teaching games do not provide the players with the ability to make outcome-affecting decisions which are affected by risk, and more particularly how risk identification and mitigation can affect the overall value of a project. Broadly and generally defined, project management is the art (and/or science) of optimizing the scheduling and optimizing the allocation of physical and personnel (labor) resources to complete a complex task set. The object of the complex task set can be, for example, a construction project such as building new homes, commercial buildings or public roadways, or can be the development of a new product line for a company engaged in the business of selling products. Whatever the type of project, the most beneficial management of a project is generally believed to be that which causes the project to create the most value for the entities which invest in the project. Value is not strictly limited to return on invested capital, although it is an important measure, but may include numerous other characteristics such as numbers of customers, market share for a product, numbers of users, traffic congestion relieved (such as for public roadway projects).

It is desirable to have a game which teaches project management skills, and more particularly, teaches such project management skills in a way which trains the project participants to work on a project so as create the most value consistent with other project requirements. It is also desirable to have a game which teaches project management skills in a manner which accounts for real-world risk of task failure, and teaches the participants to deal with costs and benefits of identifying and mitigating risk.

SUMMARY OF THE INVENTION

One aspect of the invention is a game for teaching project management skills is disclosed. The game comprises a play space including an area to track progress of preselected project tasks. The preselected project tasks when completed constitute completion of a game project. The game includes indicators for amounts of work effort for workers assigned to the project tasks by the players, indicators for tracking the project tasks, and project funds. In one example, the workers assigned to project tasks incur a predetermined amount of project funds to be expended during each project time period. Another example includes indicators for time delay for completing the project tasks, and indicators for task errors. The game includes first information indicators for each project task, each of these stating a total work effort to complete the task, amounts of non-work effort project funds costs to complete the task, and in one particular example, an inherent delay time for each task and a minimum task completion time. The game includes second information indicators for identification and mitigation of a risk associated with the project tasks. Each second indicator provides first and second consequences comprising at least one of the following: additional work effort to complete the task, additional project funds cost for the task, delay in completing the task, and accumulation of additional errors in completing the task. The first consequences are incurred when a first probabilistic event occurs and the risk is mitigated by the players. The second consequences are incurred upon occurrence of a second probabilistic event when the risk is not mitigated. Occurrence of the first and second probabilistic events is determined by a random event generator, which in one example can be a dice roll.

In a particular embodiment of the invention, the value of the project is decremented by the number of errors accumulated. In one example of the invention, the project when completed has a nominal value for completion within a predetermined scheduled time and without errors.

Another aspect of the invention is a method of playing a game for teaching project management skills. The method comprises players scheduling and assigning project tasks from a predetermined set of tasks associated with a game project. The players initiate selected ones of the scheduled project tasks. The initiating includes assigning workers, and electing whether to mitigate a risk associated with each such task.

A project time period is incremented, causing commensurate progress on each initiated task. In one example embodiment the incrementing can also result in a corresponding reduction in an amount of an inherent time delay for each initiated task. The incrementing includes expending an amount of project funds based on a number of workers assigned to each task during each increment of the project time period. In one example, upon each task having all work effort necessary for completion, a random event generator is operated, and a consequence is determined. The consequence is based on whether the risk has been mitigated by the players and whether a probabilistic event occurs. If the risk has been mitigated, first consequences are incurred based on occurrence of a first probabilistic event. If the risk has not been mitigated, second consequences are incurred based on occurrence of a second probabilistic event. The occurrence of the probabilistic event is determined by the random event generator. In one example, the first consequences and second consequences include at least one of the following: additional time to complete the task or project, expenditure of additional project funds to complete the task or project, extra work effort to complete the task or project, and accumulation of additional errors.

The initiating, incrementing and determining are all repeated until all the tasks associated with the game project are completed. In one embodiment, the value of the project is then calculated. The value is decremented from an initial amount of value based on the number of errors accumulated. In one example, the number of errors is accumulated, in addition to those accumulated by the risk event, by an amount based on a number of project tasks in progress during each project time period.

BRIEF DESCRIPTION OF THE DRAWINGS

FIG. 2 shows an example of a task or activity set for a particular simulated project which can be used with one embodiment of the invention.

FIGS. 7A, 7B and 7C show an example of flow charts for the functions performed by the various players in the example game shown in the preceding Figures.

DESCRIPTION OF THE PREFERRED EMBODIMENT

Figures 0, 1:
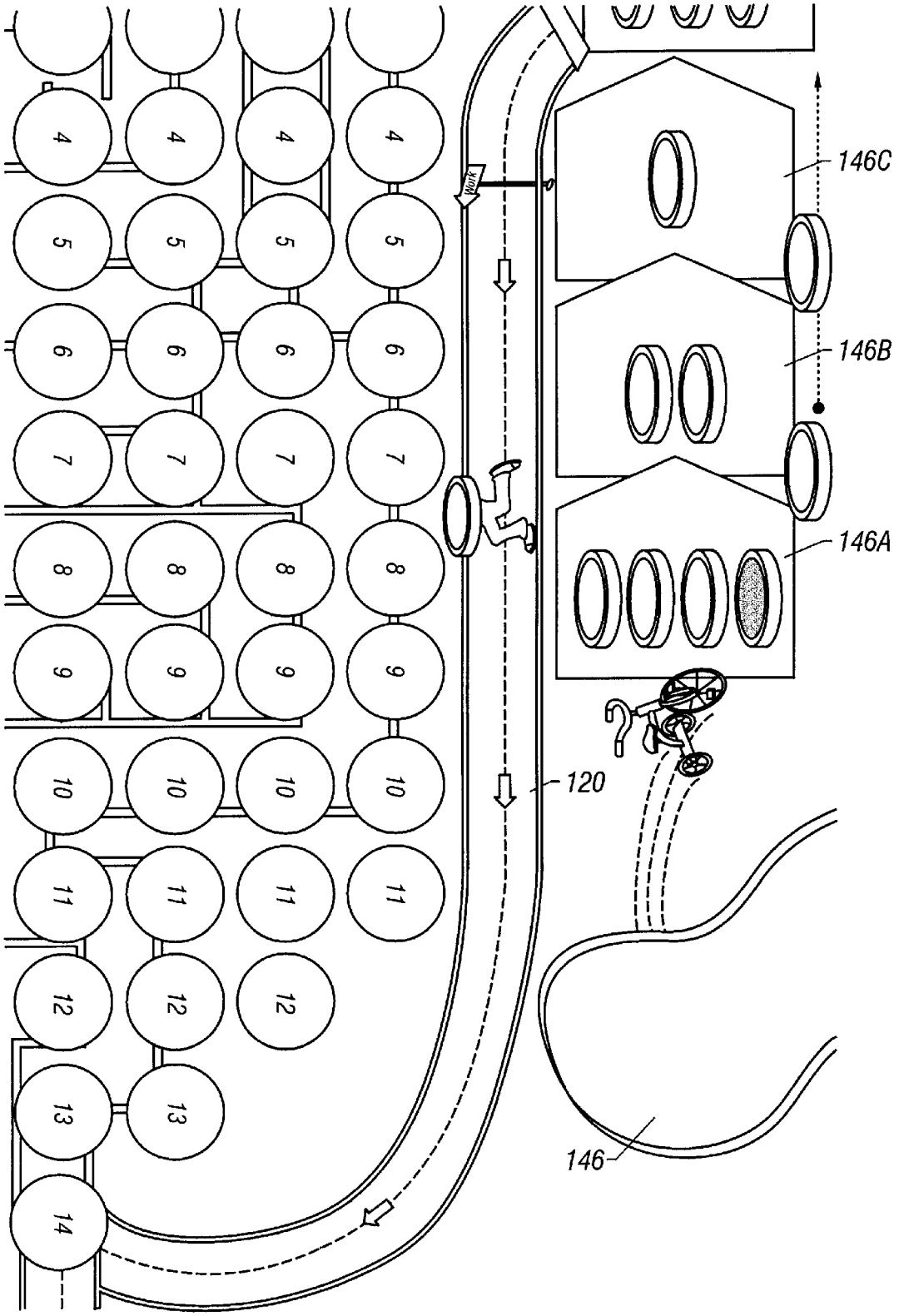
FIG. 1 shows an example of a game board used with a game according to the invention.

The invention can be better understood by referring to an example of a game board, shown generally at 100 in FIG. 1. It should be clearly understood that while the embodiment of the invention described herein is explained in terms of a physical game "board", the invention is not intended to be limited to play on a physical board. Any other medium of expression in which the elements described herein can be displayed, such as a projector, video monitor, or the like can also be used with this invention.

The board 100 can include play areas for three types of game participants. These game participants in this example represent people who are typically involved in performing the tasks associated with a project. In this example, the board 100 includes play areas for project "generalists", shown at 102, project "specialists", shown at 104, and a project manager, shown at 106. The functions of each of these types of players in this example will be further explained. The role in the game of each type of players, however, can be carried out by a single person or by a group of people. The numbers of people taking on the role of each type of player in the game can depend on, among other things, the type of project being simulated by the particular play of the game, the number may be fixed, or the number may be selected by some other criterion, but it should be clearly understood that the numbers of people acting as each type of player is not intended to limit the invention.

The play areas 102, 104 for the generalists and specialists, respectively, in this example each include a "work in progress" tracking area to facilitate tracking the progress in completing various project tasks undertaken by the specialists and generalists. The project tasks, which will be further explained, are assigned to the specialists and generalists by the project manager. These work-in-progress areas are shown at 108 for the specialists, and at 110 for the generalists, respectively, and can be a series of circles, arranged in lines, to track task progress. Finished task areas, shown respectively at 116 and 114, are located at the end of each series of circles. The circles in this example each represent a number of weeks needed to finish the particular task, and each is located a corresponding distance from the finished task areas 114, 116. Each finished task area 114, 116 in this example includes a delay circle 114A, 116A, respectively. The delay circles 114A, 116A are used to hold indicators or representors, which in this example can be distinctly colored poker chips or the like, corresponding to a time delay inherent to the particular task being tracked on the corresponding line of circles. The inherent time delay will be further explained.

The play areas for the generalists 102 and specialists 104 in this example each include a respective labor pool 146, 148. The labor pools 146, 148 represent available but as yet unassigned (not yet hired) workers. These workers may be assigned, at the discretion of the generalists or specialists, to work on assigned tasks, as will be further explained. In this embodiment of the invention, the workers assigned to a particular task are preferably divided into three categories, shown on spaces 148A, 148B and 148C for the specialist-directed workers, and at 146A, 146B and 146C for the generalist-directed workers. Each such category of workers has a corresponding number of work-weeks of work product output, or "effort", which can be "performed" by each worker in each such category. In this example, newly hired workers (those on their assigned task for the first work-week) will have a particular productivity, which in this example is one-third (⅓) work-week output per week of time spent on the task. Each unit of potential work output for each such assigned worker can be represented by an indicator such as a distinctly colored poker chip or the like. As a particular worker remains on a task for additional time, his output in each of the subsequent time periods (weeks) will be commensurately increased, as in this example, to two-thirds (⅔), and then to three-thirds (one whole) of a work-week of output for each week assigned to the task. In any case, however, each worker assigned to a particular task "costs" the generalists, and specialists, respectively, a predetermined amount of money, withdrawn from a "budget". In this example, each hired worker "costs") the assigning generalists or specialists $1,000 per work-week. Representors or indicators for a such a budget are shown at 128 for the specialists. The representors, such as shown at 128, may include play money or the like (not shown in FIG. 1) to help the particular player keep track of the flow of his budget "funds". In this particular example, the generalists are employees of the same entity as the project manager, so the generalist "budget" includes funds allocated from the project manager's budget. The specialists earn "payments" from the project manager as they finish assigned project tasks. The money provided by these payments can be "spent" by the specialists to pay for their assigned workers. However, the location of the particular budgets, or whether they are entity-based on player-based, is not intended to limit the invention. The payments for workers is intended to provide a mechanism for the specialists and generalists to account for the overall cost of the labor resources they elect to allocate to each assigned project task.

An advantage of providing time-, and experience-dependent worker productivity, as in this example, is to better simulate real-world productivity of workers. Workers are typically known to become more efficient when working on a particular task or on similar tasks for extended periods of time, while less task-experienced workers typically have lower productivity. The average payroll cost of the less experienced workers, however, is typically only marginally different than that of the more experienced workers. Such a weighting of productivity for the workers based on their time-on-task provides the specialists and generalists with the opportunity to make worker hiring/firing decisions which have real-world-like consequences. For example, firing experienced workers may cut overhead during slack work periods, but may increase overall costs for a particular task if workers have to be rehired when demand recovers.

Another aspect of worker cost allocation in this example is provision for overtime payments. As previously explained, each worker has an experience-related productivity, or normal expected work product output per week. In some instances, a project task may be better served by increasing the amount of work product output provided by assigned task workers beyond the normal amount, rather than hiring additional workers for the task. In these cases, the generalists and specialists may elect to pay for "overtime". Overtime can be allocated to each assigned project worker by "purchase" of appropriate indicators, such as distinctively colored poker chips or the like. Purchase of such overtime in this example is on a weekly basis and will increase expenditure of funds for each work-week that the overtime is purchased. This is intended to simulate the real-world basis for deciding whether to pay overtime to currently employed workers, as will be further explained.

Some of the tasks which are completed by the specialists and generalists are "precedents", or prerequisites for starting work on other assigned tasks in the project. Such "precedent" tasks when completed can be registered on an indicator, such as shown at 126. The types of tasks which are precedent tasks will be further explained. As will also be further explained, the generalists or specialists (whomever has been assigned the task) may elect to perform such precedent tasks in the proper time-order, namely prior to other tasks for which the precedent tasks are prerequisites. The specialists and generalists may elect, however, in some cases to perform the precedent tasks after their associated dependent tasks. Making such election to prematurely perform a task, however, typically will incur some form of penalty. The penalty, for example can be direct expenditure of additional project funds, incurring extra worker time to be spent on the task, or accumulating additional errors in the completed task which may require reworking the task or may incur a delay in starting other tasks.

The penalty provision for premature task initiation is intended to simulate real-world consequences of decisions to perform tasks out of sequence or outside of particular task specifications. In certain instances, the penalty can be less adverse to the overall value of the project than would be performance of the task to specifications. In this example, one of the roles of the specialists and generalists is to determine when conditions exist which favor such out-of-specification performance and acceptance of the penalty, instead of performance according to specifications. As will be further explained, proper identification of, and appropriate scheduling decisions based on such circumstances will result in increased project value.

Other tasks, when completed, provide a so-called "deliverable". The deliverable can simulate real-world project elements such as a completed foundation for a building, a completely installed plumbing system on a house, or a completed software program ready to deliver to customers, for example. A completed project in this game will preferably have a number of such "deliverables", just as a real-world project will include a number of elements such as just described. An indicator or representor for each deliverable, which in this embodiment can be a plastic building block or the like (such as ones sold under the trade name LEGO®) can be placed on a project completion area, shown at 112, when the so-called "deliverable" task is completed. In this embodiment, the plastic building blocks are to be arranged in a predetermined pattern. The pattern consists of particular locations for each specific block. Each deliverable is represented in this example by a plastic building blocks which has a predetermined size, shape and color. The size, shape and color may for convenience bear some relationship to the size, cost and complexity of the task, but this is not intended to limit the invention. The arrangement of the blocks in the completion area 112 is predetermined for each type of project to be simulated by the game. Factors which may be considered when designing the particular arrangement include the complexity, risk of error/failure, inherent delays and cost for each individual task. The selected arrangement in the pattern is not meant to limit the invention, however.

As will be further explained, a purpose for the selected arrangement in the completion area 112 is to provide the players with the opportunity to decide whether and to what extent to change or replace the deliverables for substitutes suggested by, for example, "stakeholders" in the project. This is intended to simulate real-world changes in the scope and/or specifications of a project, or any of the tasks on the project, which can arise after the project task is started. As an example, a completed plumbing installation may be represented by a particular size and shape of building block. At a stakeholder meeting with the project manager (which will be further explained), a stakeholder may suggest substituting a different grade of pipe for the one specified. The players (specialists or generalists) assigned to do the particular task may, based on predetermined costs or benefits of complying, and predetermined costs for failure to comply with the stakeholder request, elect whether to redo the particular task. If the players elect to redo the task, in this example, the color of the deliverable block may be changed to indicate that the change in scope was included to the project as requested.

As will be further explained, some completed tasks for which a deliverable has been included in the completion area 126 may be subject to rework in the event that a certain number of errors have occurred. A rework path 112A may be provided for the deliverable representors (plastic blocks) for each such error-bearing task. Other completed tasks may provide the specialists or generalists (whoever had completed the particular task) with increased knowledge about a similar task to be completed in the future, or for other tasks related to the project. In such cases, the generalists or specialists will receive a product understanding indication, such as for example from cards drawn from a stack, shown generally at 118. The significance of the "product understanding" cards will be further explained.

Work-time to be expended by each representative "worker" assigned by the generalists or specialists to a task can be represented by an indicator such as distinctly colored poker chips or the like, which for convenience of the players in keeping track can be stored in portions of the respective play areas such as shown in FIG. 1 at 150, 152 in the generalist play area 102 and at 154, 156 in the specialist play area 104. The storage portions 150, 152, 154, 156 may be divided as shown in FIG. 1 into straight-time areas and overtime areas. As previously explained, each worker will provide each project-week a number of work output units (e.g. ⅓ work week for each week on the task). As previously explained, in some cases the generalists or specialists may elect to pay a sum of money from their respective budgets to purchase overtime for any number of task-assigned workers for certain task periods, rather than hire new workers. In this embodiment, overtime is "purchased" by paying $1,000 for two overtime work-unit representors (which as for the other representors can be distinctly colored poker chips or the like). Project tasks which the project manager assigns to the generalists and the specialists can be communicated to them, respectively, by the project manager placing an appropriate indicator or representor in an inbox, such as shown at 142 and 140, respectively.

The example embodiment shown in FIG. 1 includes "work flow paths" such as shown at 120A where task status information is communicated between the specialists and the project manager, and between the generalists and the project manager. the work flow paths 120A are only provided on the board 100 in this example to convey the mental concept of a work flow path and should not be construed as a limitation on the invention. Any other convenient means of tracking task and work flow in the game can be used.

After a task is completed, the specialists and generalists (whichever has completed the particular task) will report this event to the project manager, in this example by placing an appropriate indicator or representor in an inbox 144 for the project manager. As with all the other indicators or representors in this example, the form of indicator is not critical to the invention and may be any device useful to track the position in the game of the particular item.

Some project tasks can incur errors during execution or on completion. Errors represent such real-world execution deficiencies as failure to complete the task within a predetermined budget, failure to complete a task on time, failure of the task specification to meet customer requirements, among others. In this example, the methods by which errors are calculated will be further explained, however, errors in task execution by the generalists or the specialists can be counted in an appropriate indicator storage area, such as shown at 122 and 124, respectively. The errors can be counted by any useful indicator such as distinctly colored poker chips or the like, as for other indicators in this game. As will be further explained, some types of errors may be removed from the count by reworking the task or other means. Still other types of errors cannot be reworked but instead reduce the overall project value.

Each task in this example embodiment, as will be further explained, has with it an associated risk of error or failure. The degree of risk will be identified on the task instructions communicated to the specialists and generalists by the project manager. At the time a task is assigned to the generalists or specialists, the respective players in this example will decide whether to mitigate the risk. In this context, "assigned" means that the project manager has informed the respective players that they will ultimately be responsible for completing the task, rather than an instruction from the project manager that they will be expected to perform on the task during the succeeding work-week. Generally this means that mitigation must be elected immediately after the project manager generates his initial project schedule. Instructions on mitigation, such as how much extra effort, extra expenditure, or additional time delay to complete the task may result from such mitigation, as well as the benefit of mitigation or the detriment from failure to mitigate, can be stored on appropriate indicators, cards or the like in conveniently located spaces such as at 136 and 137, respectively, for the generalists and specialists.

The project manager's play area 106 in this example includes a scheduling grid, such as shown at 176. In this example the grid 176 is arranged as a Gantt chart so that the project manager can arrange tasks by expected work duration, and the intended start and completion times. The project manager has a fixed amount of his own personal work time each project-week, which in this example cannot be increased by overtime or the like. This is representative of a real-world project manager, whose time is ultimately limited. Time indicators, which in this example are distinctly colored poker chips or the like, can be stored in a convenient location on the board 100 such as shown at 168 in FIG. 1.

In this example, the project manager must decide how optimally to expend his limited time, as well as scheduling the tasks which make up the complete project. Some of the project manager's time can be expended, for example, by having simulated "meetings" between himself, the specialists and generalists. Such "meetings" serve the purpose of reducing a real-world error-causing factor, which in this example is referred to as "communications overhead". Communications overhead is provided in this embodiment to simulate a real-world condition where the failure of all project workers to understand project purposes and the tasks being worked on by other people associated with the project can result in less than optimal performance by all project workers. It is frequently the case that failure of project personnel to have this knowledge and understanding leads to worker decisions which are facially correct but have unintended adverse consequences to the project as a whole when another aspect of the project is not performed according to specification. The following example will illustrate the consequences of "communications overhead". In a home building project, for example, a cement contractor may have a financial incentive in his contract to pour a foundation on or before a specified target date. Failure to communicate to the cement contractor that, for example, a plumbing contractor had to rework certain in-foundation pipes before foundation pouring might result in the necessity to break up and remove large portions of the foundation if the foundation were poured prior to the needed plumbing rework. In this brief example, proper communication between the other project-team members and the cement contractor could have resulted, instead, in the contractor electing to take payment in lieu of his financial incentive, or some other remedy, in order to wait to pour the foundation, rather than properly performing his own task, because the unforeseen events in this example caused a situation where proper performance by the cement contractor would have adversely affected the project as a whole, even if the cement contractor would have benefited himself by proper performance of his contract. The "communications overhead" factor in this embodiment is intended to simulate this real-world situation associated with performance of numerous and/or complicated tasks on a project. In this embodiment, the communications overhead can be counted in a conveniently located register, such as shown at 138, where indicators such as poker chips or the like are stored. Communications overhead in this example is reduced by the project manager using some of his time (and concurrently some of the specialist and generalist time) to hold simulated project "meetings". The communications overhead in this embodiment is increased by an amount related to the number of tasks each of the generalists and specialists have ongoing during any project work-week. Other formulas can be used to determine the amounts by which to increase and decrease of communications overhead. The example described here is not meant to limit the invention but is only intended to illustrate the use of "communications overhead" as a value-affecting factor in the outcome of the game.

The project manager's play area 106 may include an area 134 for accounting for his project budget. Budget "funds" which are expended other than by payment to specialists for work performed can be accounted in a space such "burned budget" space 132.

An advantageous aspect of the game in this example is a provision for interaction between the "stakeholders" (investors) in the project and the project manager. Stakeholder support for the project can be simulated by counting an indicator such as distinctly colored poker chips or the like. As in a real-world project, stakeholder support in this example can be increased by such actions as the project manager spending some of his limited time "meeting" with the stakeholders to review the project's progress. In this example, stakeholder support is reduced by a fixed amount each project-week, which is intended to simulate a real-world aspect of investor support in that such support is known to decrease over time unless effort is expended to maintain personal relationships between the project manager and project investors.

Stakeholder support accounting in this example can have several purposes. First, for example, should a project exceed its budget because of unforeseen errors or delays, or proposed improvements to the project which may ultimately result in greater value, accumulated stakeholder support can be exchanged ("spent") for additional "funding" for the project. Another aspect of stakeholder support in this example is a provision whereby stakeholders provide input to the scope and specifications of the project. In this example, such input is represented by stakeholder input cards, which can be stored at a convenient location on the board 100 such as 174 in FIG. 1. Where the project manager elects to "meet" with stakeholders to conduct progress reports, as in this example, stakeholder support can be increased by placing predetermined numbers of the indicators or representors at a convenient location on the board 100 such as 172 in FIG. 1. At the same time, a stakeholder input card is taken by the project manager. The information obtained from these cards will be further explained, but it should noted here that changes in project scope, some of which can materially increase project value, are typically provided on these cards. Another aspect of stakeholder support in this example is that some stakeholder input is actually detrimental to the overall value of the project. The project manager in this example can decide to use some of his accumulated stakeholder support in exchange for electing not to make the project scope changes proposed by the stakeholder. In this example, eight stakeholder support indicators are used to elect non-performance of one stakeholder change suggestion. This aspect in the present embodiment is intended to simulate real-world choices available to a project manager, where refusing to honor a stakeholder request may risk future funding, but may ultimately provide higher overall value to the project by avoiding value-reducing changes to the scope or specifications of the project.

The value accrued by performing all the task associated with the project in this example game can be counted on a "customer pole" shown at 160 in FIG. 1. In this example the customer pole 160 includes individual tokens (not shown separately in FIG. 1) each of which represents a unit of project value, a number of customers for a product, or the like. In this example each token represents $10,000 value. A project specification, which will be further explained, as well as other factors such as errors, changes in product specification or project scope, can result in additions to or subtractions from the number of tokens stored on the customer pole 160. The overall result of playing the game is related to the number of value tokens accumulated on the customer pole 160, it being generally the case that accumulation of more value tokens is indicative of having better managed the project.

Representors or indicators for the previously described tasks associated with a game project are shown in FIG. 2. These indicators or representors are used by the project manager for scheduling the tasks. In this example, the project tasks are each represented on a square or rectangular "card" which fits on a corresponding space on the project manager's scheduling chart (176 in FIG. 1). Each task representor is preferably marked with a task number for convenience of tracking the task's progress, an illustration or other indication of any deliverable if associated with the task (or an indication that the task is precedent-only), an indication of any precedents which must be completed before the task is started, and a risk level associated with the task (which in this example is low, medium or high). Additionally, the tasks can be color-, or otherwise coded to indicate which of the players (generalists or specialists) is to be assigned the particular task. The task indicator set shown in FIG. 2 can be provided with a complete game set as a whole card 10, which can be separated into its individual task pieces. However, this form of task representor should not be construed as a limitation on the invention. In this example, the players to whom the task is to be assigned are predetermined, however this is not to be construed as a limitation on the invention. Another embodiment of the game may, for example, provide for full discretion by the project manager as to assignment of tasks.

Figure 3:
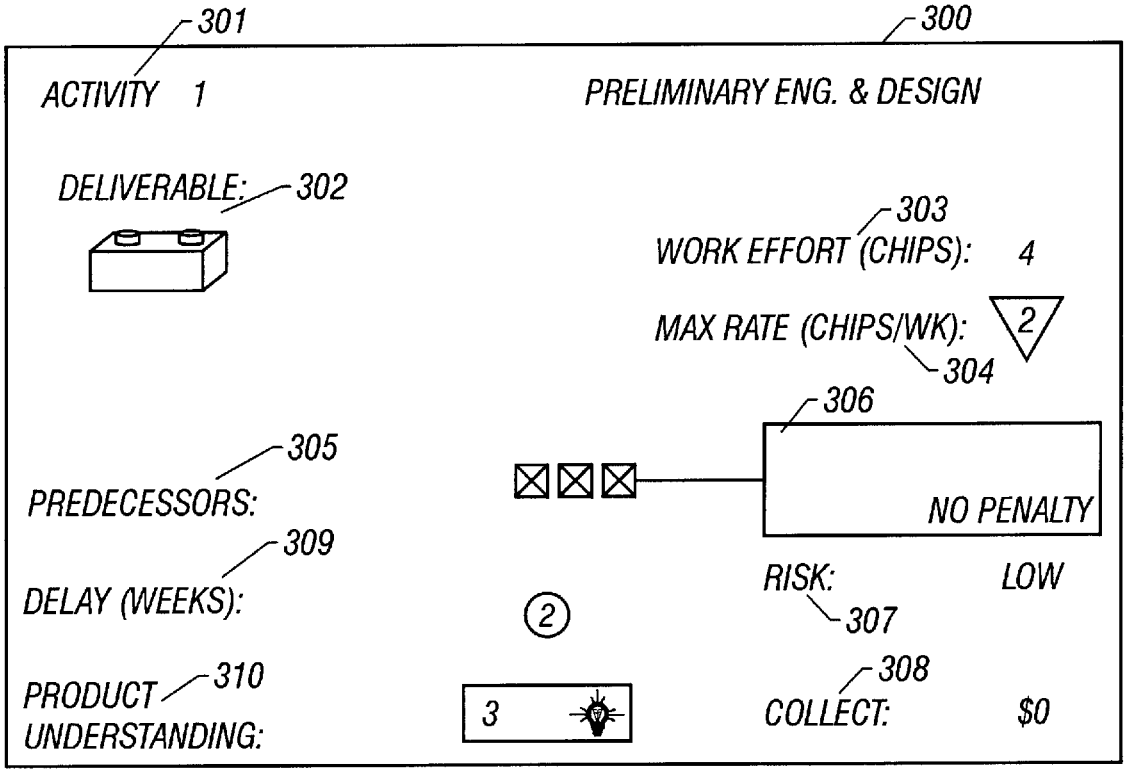
FIGS. 3 and 4 show an example of an activity description card related to the tasks or activities in the example project task set of FIG. 2.

As previously explained, the project manager assigns a task to the generalists or specialists, depending on the nature of the task set. Upon assignment, the project manager places an appropriate indicator or representor in the respective inbox (142, 144 in FIG. 1) for the generalists or specialists. After receipt of the task indicator, the receiving generalists or specialists retrieve, for example from a central file (not shown), a task activity card, an example of which is shown at 300 in FIG. 3. In this example, the task activity card 300 is marked with the number of the activity 301 (which may optionally be color coded with the player responsible for its completion) corresponding to the number on the project manager's card (10 in FIG. 2), any deliverable 302 from the task, the numbers of the precedent tasks which must be completed before starting the present task 305 (marked with numbers in blocks to the right of the word "precedent"), and whether any penalty applies for starting the present task prior to completing all the precedents, shown in box 306. The card 300 in this example is also marked with the previously described "inherent" delay 309. The inherent delay, as previously explained, is an amount of time before which the task cannot be completed, even if all the work has been performed. The delay is intended to simulate real-world situations where a project task cannot be completed prior to events occurring which are beyond the control of the person performing the task. For example, a completed house cannot be occupied in many cities prior to obtaining an "occupancy permit" or similar municipal certificate. If the task calls for completion of the house, and completion is defined as obtaining the occupancy permit, it should be apparent that true "completion" of the task as defined is outside the control of the house builder, even if he completes all the work associated with the actual construction of the house The card 300 in this example includes the total labor (work effort) required to complete the task, shown at 303. A maximum weekly work-rate that can be devoted to the task is shown at 304. The maximum weekly work rate is provided to simulate the fact that many tasks cannot be completed faster than at a particular rate irrespective of the number of people assigned to the task. The risk associated with the task is marked at 307. Any "cash" payment to be received on completion of the task is shown at 308.

The card 300 in this example also includes a number of product understanding indicators or "cards" which may be obtained on completion of the task. The number of product understanding cards to be obtained varies with the task. In this example, the number of product understanding cards is scaled so that the player assigned to complete the task can make a decision whether to perform certain tasks earlier than others by selective allocation of labor resources (worker time). Tasks which have high product understanding amounts, as will be further explained, provide a greater possibility of increasing the efficiency with which later tasks are performed, such as by suggesting task modifications which increase value of the final project, or reduce the labor required to complete the task, for example.

Figure 4:
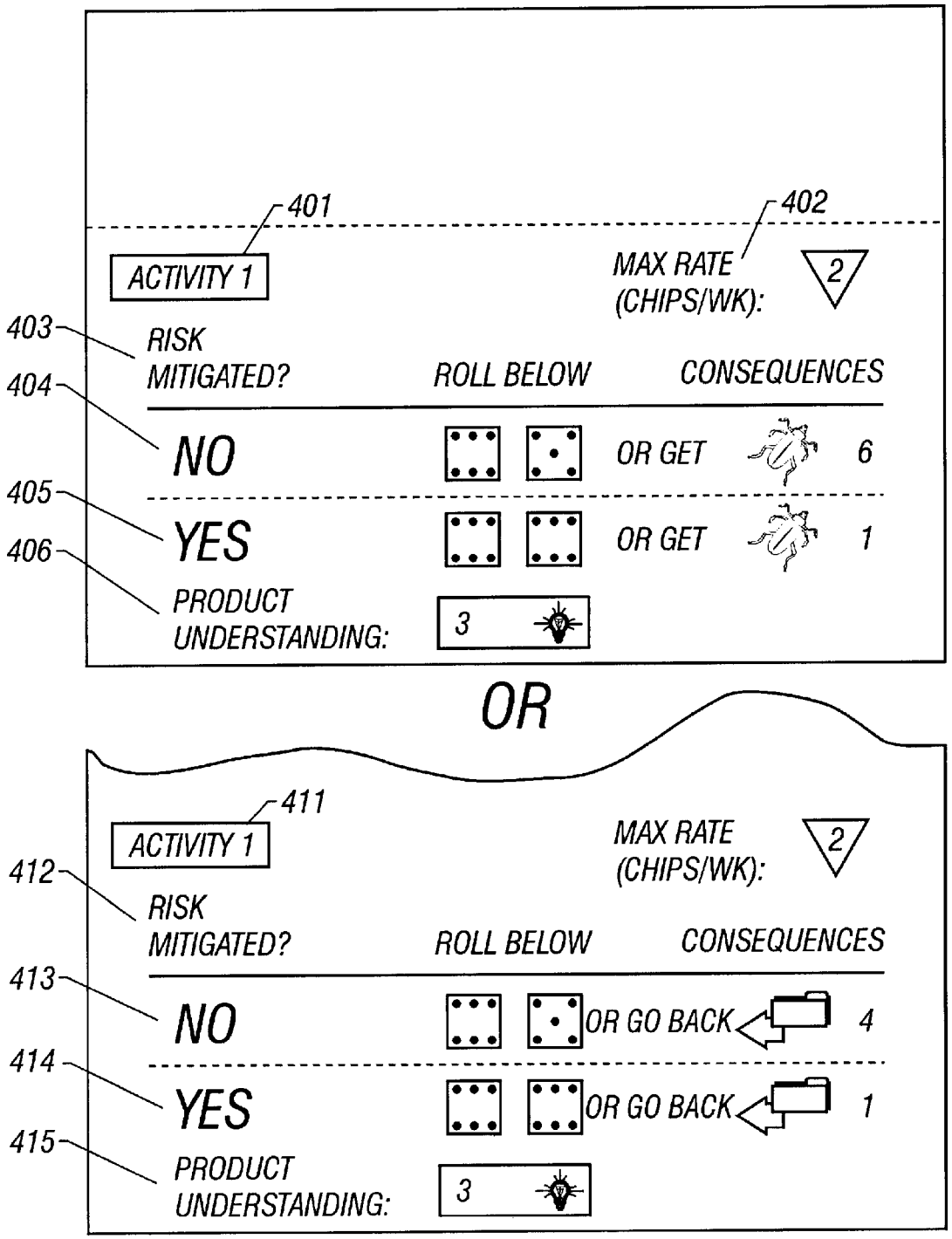

FIG. 4 shows another aspect of the task activity card. In this example, the information in FIG. 4 is printed on the inside of a folded task activity card such as shown at 300 in FIG. 3. However, the information need not be so presented, and if desired, the information shown in FIG. 4 may be placed on separate indicators or cards of any type. The purpose of the information shown in FIG. 4 is to provide the particular player with a basis for deciding whether to mitigate or to accept the risk associated with the particular task. As previously explained, the player(s) assigned the task decide(s) on receipt of the task instruction whether to mitigate the risk. The task is indicated at 401, and optionally the maximum work-rate is indicated at 402. Whether mitigation was elected is shown at 404 (if no) and 405 (if yes). At the time a task is completed, prior to forwarding the task deliverable, the task-performing player rolls dice, or operates any other type of random number or random event generator. This is intended to simulate the inherent uncertainty associated with risk. If risk is mitigated, in this example the player must roll less than twelve (very high probability) or incur one error on the task, by accumulating one error indicator. Optionally, the number of product understanding cards for the task may be again shown as at 406. If mitigation is not elected, the dice when rolled (or random number or random event generator operated) must indicate below eleven (a high but reduced probability from the mitigated case), or in this example the player will receive six errors for the task. Alternatively, as shown at 413 and 414 in the lower part of FIG. 4, failure to mitigate can result in the loss of work time. In this example, failure to mitigate, and an unfavorable dice roll, will result in the task being set back on the work-in-progress area (108 and 110 in FIG. 1) by four "weeks", which in this example means that a task-in-progress indicator is moved away from the "finished" area (114 and 116 in FIG. 1) by an equivalent number of circles or spaces along the line. A consequence of moving the task indicator back by a number of weeks in this example is that additional work must be performed to complete the task. Because each of the workers assigned to the task must be "paid" out of budget finds each week, the result in the end is additional cost to complete the task. The probabilities described in this example are only meant to illustrate the principle in the game of risk-weighted consequences which may affect the outcome of a project task. It should be clearly understood that the numerical probabilities and the consequences described herein are not meant to limit the invention, as other numerical probabilities and consequences can be readily selected which would reasonably represent risks associated with other types of tasks, or tasks associated with other types of projects.

It should also be understood that the foregoing example of allocating and determining consequences of risk, where the risk is allocated to individual project tasks is only one way to include the element of risk in the game. An important attribute of including risk in the game of this invention is to provide the players with the opportunity to decide whether the possible "payoff" from allocating project funds and work effort to risk reduction is more valuable to the project overall than is the "cost" to the value of the project of the resulting consequences where the risk is not mitigated. Another example of including risk in the game is to allocate risk on an aggregate basis to the entire project. One way to do this would be to assign an initial quantity of risk to a complete project, such as by having an initial quantity of risk "indicators" such as distinctly colored poker chips or the like. The initial quantity can be related to the complexity of the project, its initial value, or any other convenient reference. During the course of the game, at selected times, such as for example, during each project work-week, the specialists and generalists can decide whether to allocate some of the work effort provided by the workers, and may decide to spend some additional amount of project funds, to reduce the number of risk indicators. The workers whose effort is allocated to risk mitigation may be those assigned to project tasks, or may be additional workers hired specifically for the purpose of risk mitigation. The number of risk indicators removed by allocation of work effort and project funds is a matter of discretion for the game designer. At selected times during the game, which may be on completion of the project or at any other predetermined time, the players will operate the random event generator, such as rolling dice or the like, and will thus determine consequences based on the number of risk indicators at the time of the random event. The consequences should include at least one of the following: expenditure of additional project finds to complete a task or the entire project; requirement to expend more work effort to complete the project or an individual task; accumulation of additional errors; and time delay to complete a task or the entire project. In this example of risk inclusion, both the probability of occurrence of the event and the magnitude of the adverse consequences of the event should be related to the number of risk indicators in the counter at the time the random event generator is operated, and the probability and magnitude of the consequences should be available to the players in some form, such as on an information card or the like so that the players can make an informed decision as to whether and to what degree to mitigate the risk during the course of the game. It is clearly within the contemplation of the invention that certain circumstances can increment the number of risk indicators, such as having a predetermined number of tasks in progress at any one time, not expending any time meeting with the stakeholders, accumulation of a predetermined number of errors, or any other convenient element which corresponds to real-world increase in risk of a project fault or task failure.

When a task is started by the assigned players (or individual assigned) player, they place a marker on the work-in-progress area a number of circles away from the finish area equal to the number of weeks it would take, absent errors or other delays, to complete the work. In this example, this number of circles or spaces is the work-effort units (shown at 303 in FIG. 3 as four) divided by the number of worker productivity units per week assigned to the task. In this example, two units per week is the maximum rate. This rate can be represented for example, by two-thirds the weekly time/effort of one "fully trained" worker (one who has been on the task for at least three work-weeks), or all the time/effort of two first-week workers, or any such combination of experience levels and fractional amounts of the workers' total work time/effort for each workweek.

Figure 5:
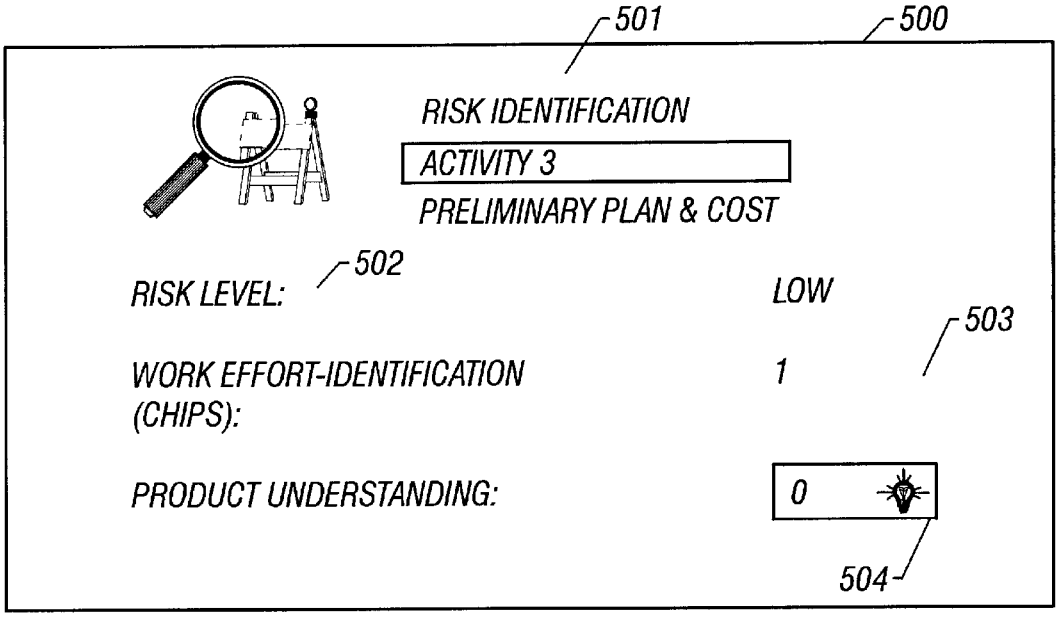
FIGS. 5 and 6 show an example of risk identification/mitigation cards each of which relates to an activity such as from one of the example cards of FIGS. 3 and 4.
Figure 6:
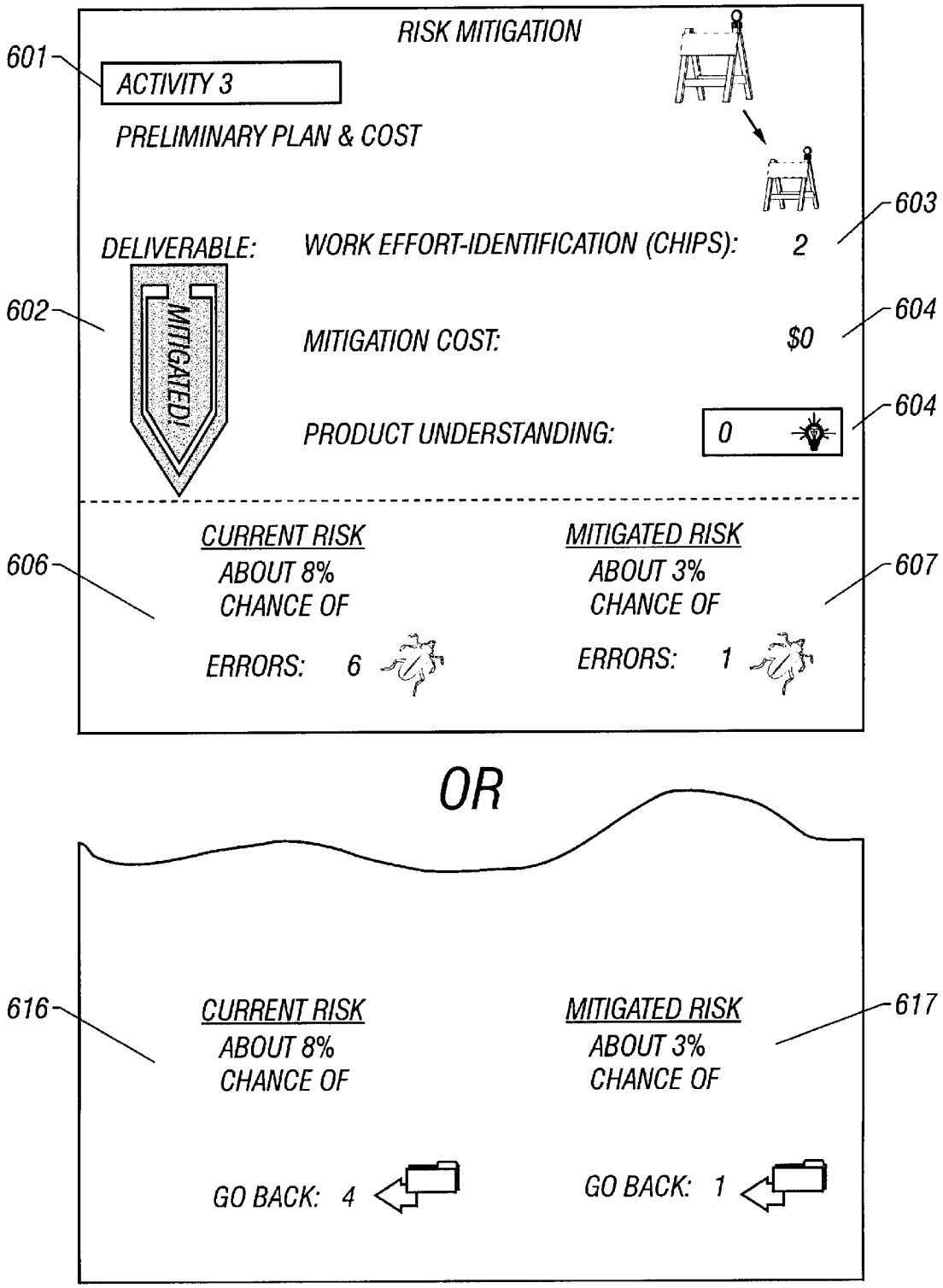

The decision whether to mitigate risk in this example is made, as previously explained, at the time the task is first assigned. If the player decides to mitigate risk, in this embodiment he draws a card, such as can be stored at convenient location on the game board 100, such as at 136 and 137 in FIG. 1. An example of a risk identification/mitigation card is shown in FIG. 5 at 500. The card 500 preferably includes the task number or other identification 501, and if desired a restatement of the risk level 502. In this example, identification of the risk will require expenditure of a certain amount of labor. This amount is shown at 503. Identification of the risk may optionally provide additional product understanding, as can be obtained by the previously described cards, and any such amount of product understanding is shown at 504. After the player has identified the risk and obtained any additional product understanding, he may then choose to mitigate the risk. Mitigation decisions, costs and consequences are shown in FIG. 6, which in this example represents the inside of one of the risk cards as shown in FIG. 5, but as is the case for the task cards, the information may be presented in any other suitable manner. Mitigation may involve expenditure of money (project funds), shown at 604, work effort resources, shown at 603, and may, as previously explained, provide some product understanding, shown at 605. Indications of the risk and consequences of mitigation or failure to mitigate are shown in FIG. 6 at 606, 607, 616 and 617. The costs, and consequences can be designed in a manner suitable to the type of task. It should be clearly understood that the example cost and mitigation consequence items shown in FIGS. 5 and 6 are only meant as examples of how to include risk identification and mitigation in the game and these items are not in any way meant to limit the invention to the items as shown. If mitigation is elected, an indicator, such as clip 602 may be attached to the card (500 in FIG. 5) as evidence of such decision to assist the players is tracking whether certain tasks have been mitigated.

Having explained the various components of the example game, the process of conducting a game as in this example will now be explained. Flow charts for the functions performed by the various players in this embodiment of the game are shown in FIGS. 7A, 7B and 7C. As previously explained, the measurement of time in this embodiment of the invention is a work-week. Events occurring in each one of the steps which are to be explained below are all intended to take place within one such work-week. Projects in this embodiment of the invention are to be completed in fifteen such work-weeks, but it should be understood that any other number of weeks may be used for different projects simulated by this game. In deciding how many such work-weeks to include in any project simulated by the game, it is useful to have such number of work-weeks bear some meaningful relationship to the time expected to be spent on the real-world project simulated by the game, but this is not a limitation on the invention.

Referring first to FIG. 7A, the project generalists at 701 check their inbox to determine which tasks have been assigned to them by the project manager. Assigned projects can be initiated by forming a so called "work package". In this example, the work package (not shown) can be a small paperboard box, folder or the like adapted to fit along one of the lines of circles in the work-in-progress area, such as shown in FIG. 1 at 110. It should be understood that representing work-in-progress using the "work package" is only meant as an example and is not intended to limit the invention. At 702 the generalists allocate selected workers from the available labor resources to tasks-in-progress and to newly assigned tasks. Newly assigned tasks, for which a new work package is prepared, have the work package placed at the proper starting space on the work-in-progress area (110 in FIG. 1). The number of delay indicators shown on the task card (300 in FIG. 3) are placed in the finish area (114 in FIG. 1) for that task at the time the task is begun. In subsequent work-weeks, each task-in-progress should be moved towards the finish area (114 in FIG. 1) by one circle, and one of the delay indicators (if any remaining) in the corresponding finish area (114 in FIG. 1) should be removed from the stack therein. At 703, any product understanding cards, which will be further explained, obtained as a result of stakeholder input, mitigation of risk, or completion of a task, are taken by the generalists. At 704 any errors resulting from unfavorable dice rolls on completed tasks, from communications overhead, or from product understanding are accumulated and the new error indicators are placed in the error indicator storage area on the game board (this area shown at 122 in FIG. 1). Errors are also reported to the project manager. At 705, the decision whether to mitigate risk on newly assigned tasks is communicated to the project manager. Completed tasks for which a deliverable is presented, have the deliverable placed on the appropriate part of the completed deliverable area (112 in FIG. 1) as shown at 706. At 707, an amount of money corresponding to the number of workers used on all ongoing and newly started tasks is "paid" out of budget funds. The generalists at this time decide whether to adjust the number of workers assigned to the tasks-in-progress and newly assigned tasks. After these seven functions are completed, the work-week is considered completed. The process just described for the generalists is repeated by the generalists in each successive work week until the end of the last work week of the project.

Referring now to FIG. 7B, the functions attributable to the specialists will be described. At 711, 712, and 713, weekly new task assignment, worker allocation and product understanding acquisition is substantially the same as for the generalists, as previously described. At 714, when reporting to the project manager, the specialists may also adjust the number of workers on their current payroll to reflect workers doing tasks not related to the project. This is intended to simulate the condition of a real-world outside contractor who may have personnel operating on non-project tasks. The remainder of the weekly functions, shown at 715–717 are substantially the same in this example as those performed by the generalists.

The functions performed by the project manager in this example are shown in FIG. 7C. The project manager preferably keeps a record of the total errors accumulated by the specialists and generalists, shown at 721. At this time, the project manager increments the storage area (138 in FIG. 1) for communications overhead. In addition to incrementing the communications overhead based on the number of tasks in progress, communications overhead in this example is also incremented by a fixed "weekly" amount to simulate risk of error inherently associated with time on a project without communication between the project manager and the workers assigned to the project. At 722 the project manager decides how to allocate his fixed, available time. Some may be used in "meetings" with the specialists and generalists, which as previously explained decrements the accumulated communications overhead by a preselected amount. Some time may be used in "meetings" with stakeholders, which as previously explained will increment the accumulated stakeholder support. At 723, the project manager in this example sets the weekly "error rate" for the specialists and generalists, which will be further explained. At 724, the project manager updates a project progress report. As previously explained, the amount of stakeholder support is decremented each work week by a predetermined amount to reflect inherent loss of support over time. At 725, the project manager takes a stakeholder input card if he elects to meet with stakeholders. These cards, which will be further explained, may include scope or specification changes to the project. At 726, the project manager updates a record of project expenses and the task schedule (at 176 in FIG. 1). At 727, the project manager indicates any suggestions on schedule modification to the generalists and specialists. The process is repeated for each subsequent workweek until the project is completed, which in this example is at the end of the fourteenth week.

Figure 8:
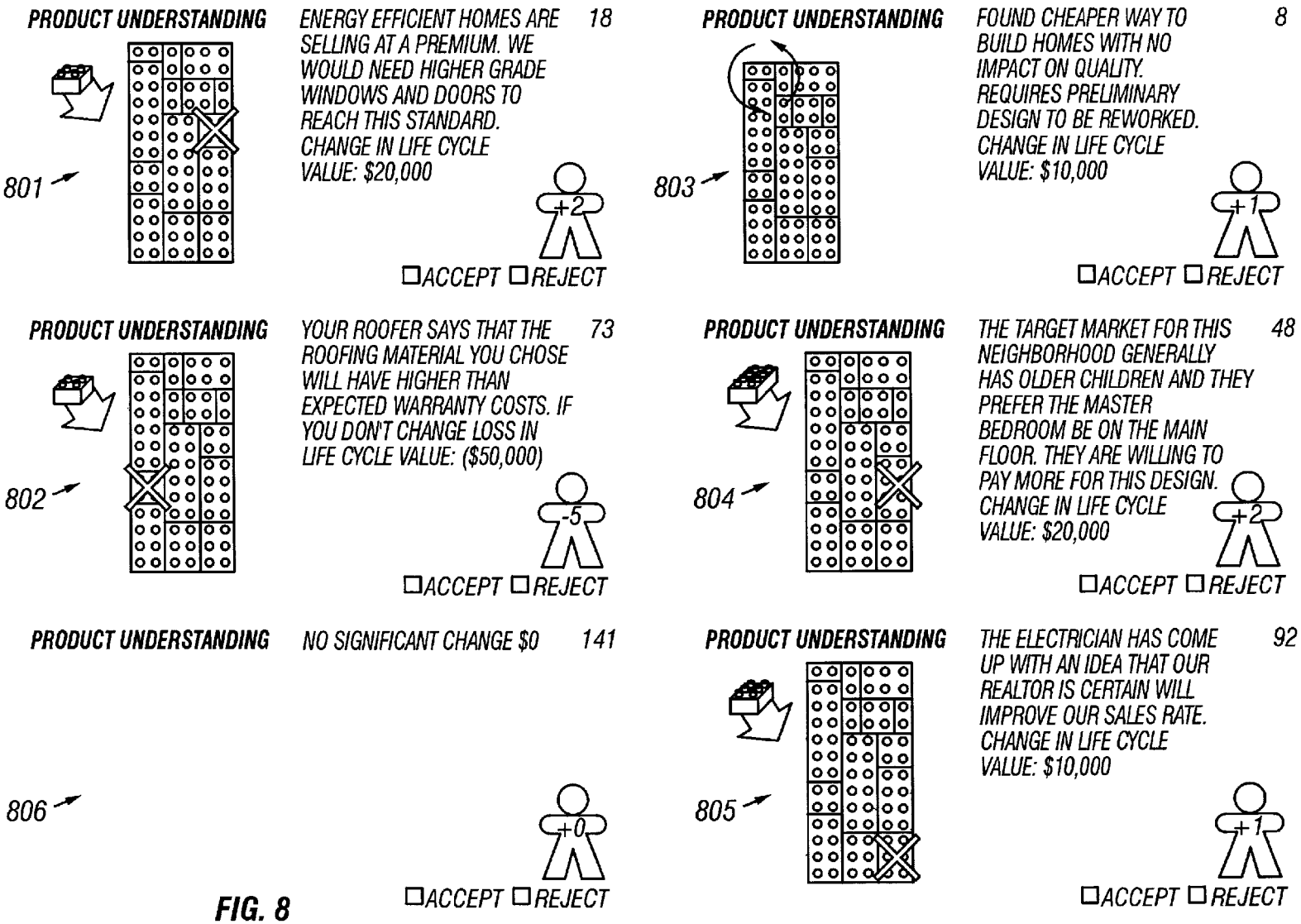
FIG. 8 shows examples of product understanding cards as used in this embodiment.

Having explained the process of this example of the game, one aspect of the game which is intended to develop particular project management skills will now be explained. A project in this embodiment of the game has a predetermined value when the project is completed on time, within budget and without errors. In one example, any accumulated errors present in the accumulation areas (122 and 124 in FIG. 1) at the end of the game can each cause a preselected reduction in the value of the project. In this example, each error reduces the project value by an amount according to a predetermined formula, which can be a fixed amount such as $1,000 per error, or alternatively, an amount per error which increases as the total number of errors increases. Referring now to FIG. 8, examples of the previously described product understanding cards and their effect on project value will now be explained. At 801, a proposed change in the specification of the project includes substitution of energy-efficient windows in a newly built home for standard grade windows. Substitution requires completely redoing the particular task which includes installation of windows. This re-performance of the task will require expenditure of additional resources including worker time and material expense, and depending on the prerequisites for that task, may delay completion of other tasks. However, the value of the project will be increased by, as in this example, $20,000. The player assigned the window installation task must decide whether to proceed with re-performance or to complete the task as originally assigned. The decision will require weighing all the economic factors which will be affected by implementing the change contemplated by the product understanding card 801. Some product understanding cards may have no proposed scope change and no consequent change in value, such as shown at 806. Still other product understanding cards may include a substantial decrease in project value for failure to implement the proposed recommendation. An example of such a product understanding card is shown at 802. Other examples of product understanding cards are shown in FIG. 8 at 803–805. The product understanding cards 801–806 as shown in FIG. 8 are related to a particular embodiment of the game which has as a project the building of a new home. The scope changes contemplated in the example cards shown in FIG. 8 are therefore related to such an example project. It should be clearly understood that there are many other possible scope changes which can be simulated using product understanding cards as shown in FIG. 8. The scope changes suggested in FIG. 8, and the project to which the changes related, as well as the form of storing/conveying the information on the cards are shown only as one example of including scope change recommendations in a simulated project, and in no way are the examples of FIG. 8 intended to limit the invention to such forms of storage/conveyance or particular scope changes.

Figure 9:
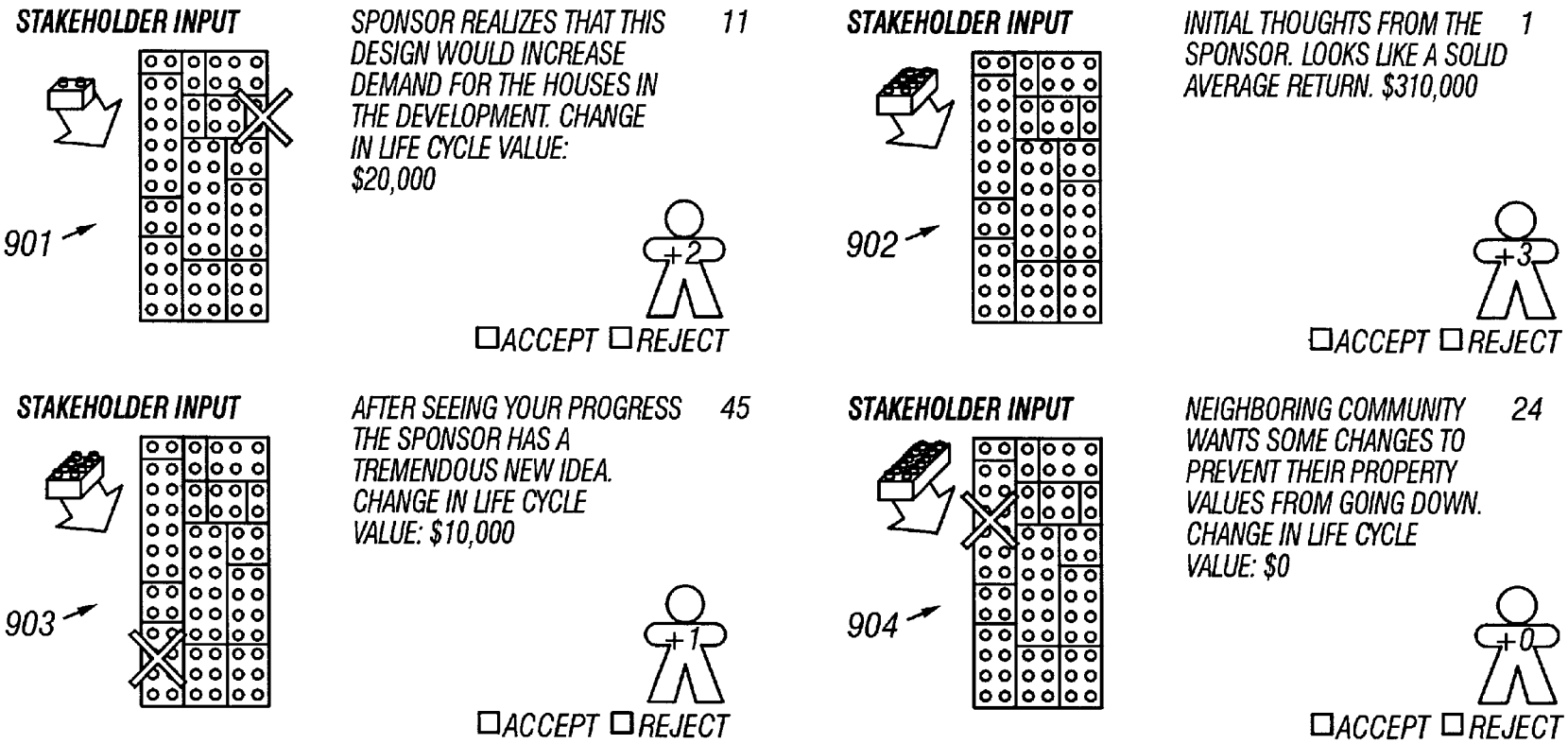
FIG. 9 shows examples of stakeholder input cards as used in this embodiment.

Referring now to FIG. 9, the previously mentioned stakeholder support cards will now be explained in more detail. At such times as the project manager elects to "meet" with the stakeholders, the project manager will retrieve a stakeholder input card from a storage location (such as 174 in FIG. 1). Each such card may have a proposed change to the scope of the project. Some of these scope changes may require total re-performance of an already complete task, but may provide the project with additional value as indicated on the particular card. Examples of such cards are shown at 901–904 in FIG. 9. The project manager must decide whether to implement the recommended change in scope of the project. In this example of the game, the project manager can decide to reject the stakeholder recommendation. It is contemplated that a reasonable project manager would make such decision on the basis that the cost exceeds the value which would accrue to the project. It is understood in this example that failure to implement a stakeholder recommendation is likely to reduce the stakeholder support for future actions of the project manager. To account for this possibility, in this example when the project manager elects to reject such a stakeholder recommendation, he must relinquish a preselected number (eight in this example) of the previously described stakeholder support indicators. As can be inferred from the previous description of the functions of stakeholder support, the project manager should weigh, in addition to the direct costs to the project of implementing an unfavorable stakeholder recommendation, the possibility of having to rely on stakeholder support for future contingencies, such as additional funding for a project which has exceeded budget forecasts.

At the end of the project, the value tokens are counted to determine the overall value of the project, as previously explained.

It will be appreciated by those skilled in the art that the foregoing description is only one example of the invention, and that many other embodiments of the invention are possible which do not depart from the spirit of the invention as described herein. Accordingly, the invention shall be limited in scope only by the attached claims.

What is claimed is:

1. A game for teaching project management skills, comprising:

a play space for players comprising an area to track progress of project tasks, said project tasks part of a predetermined set of tasks which when completed constituting completion of a game project;

indicators for amounts of work effort for workers assigned to said project tasks by said players, indicators for tracking said project tasks on said play space, and quantity representors for project funds;

first information display for each of said project tasks, each said first display stating a total amount of work effort to complete each said task, and project funds costs associated with each said task; and second information display for identification and mitigation of a risk associated with said project, each said second display having at least one of a work effort amount and a project funds cost for identifying and mitigating said risk, each said second display having consequences comprising at least one of expenditure of additional project funds, accumulation of additional task errors, expenditure of additional work effort and time delay to complete said project, said risk incurring said consequences upon occurrence of a probabilistic event, a probability of occurrence of said probabilistic event and a magnitude of said consequences determined by whether said players have mitigated said risk, occurrence of probabilistic events determined by a random event generator.

2. The game as defined in claim 1 further comprising quantity indicators for a value of said project, said value quantity indicators decremented from an initial number of said value indicators by a predetermined amount corresponding to a number of said error indicators accumulated.

3. The game as defined in claim 2 further comprising quantity indicators for stakeholder support, said stakeholder support quantity indicators incremented by a predetermined amount when a player meets with stakeholders, consuming a predetermined portion of a per project time period work effort allotted to said player, said stakeholder support quantity indicators decremented by a predetermined amount for each project time period.

4. The game as defined in claim 3 wherein said support quantity indicators are decremented by a predetermined amount when said player elects to reject a change in scope to said project proposed by said stakeholders, said change in scope comprising selected ones of additional project funds costs, work effort amounts to complete selected ones of said project tasks and additional ones of said tasks to complete said project beyond the tasks in said predetermined set, said change in scope determined when said player meets with said stakeholders.

5. The game as defined in claim 4 wherein said scope change increments said value quantity indicators of said project upon implementation by said players.

6. The game as defined in claim 3 wherein said stakeholder support quantity indicators are decremented by a predetermined amount related to an amount of additional funds beyond a preselected budget of said project funds required to complete said project, said additional finds requested by said player from said stakeholders upon meeting therewith.

7. The game as defined in claim 1 further comprising quantity indicators for communications overhead, said communications overhead quantity indicators incremented by an amount corresponding to a number of said project tasks which are in progress during any one game project time period, said overhead quantity indicators decremented by a predetermined amount when a player elects that workers assigned to different ones of said project tasks use a portion of a per project time period allotment of said work effort shall meet with each other, said overhead quantity indicators converted by a predetermined formula to a number of said errors at selected times during said game.

8. The game as defined in claim 1 further comprising quantity indicators for errors, said error indicators are incremented by an amount related to accumulation of said communications overhead quantity indicators, said communications overhead quantity indicators incremented by an amount corresponding to a number of said project tasks which are in progress during any one game project time period, said communications overhead quantity indicators decremented by a predetermined amount when a player elects that workers assigned to different ones of said project tasks use a portion of a per project time period allotment of said work effort shall meet with each other.

9. The game as defined in claim 1 further comprising product understanding displays each stating changes in a scope of said game project selected from the group consisting of task work effort amount, project funds amount, and a change in a total value of said project.

10. The game as defined in claim 9 wherein said product understanding displays are obtained by said players upon completion of one of said tasks.

11. The game as defined in claim 9 wherein said product understanding displays are obtained by said players upon electing to mitigate one of said risks.

12. The game as defined in claim 9 wherein said product understanding displays are obtained by said players from a project stakeholder input upon meeting with said stakeholder, said meeting consuming a predetermined amount of work effort allocated to said player.

13. The game as defined in claim 1 wherein said workers comprise generalists assigned to said project fill time; and specialists assigned to said project only to perform selected ones of said tasks.

14. The game as defined in claim 1 wherein said workers produce an amount of said work effort for each said project time period corresponding to a number of project time periods each said worker is assigned to a particular one of said tasks.

15. The game as defined in claim 14 further comprising overtime work effort producible by selected ones of said workers upon expenditure of preselected amounts of said project funds by said players.

16. The game as defined in claim 1 further comprising quantity indicators for an inherent time delay quantity indicators associated with each of said project tasks, said inherent time delay decremented by a predetermined amount for each project time period, each one of said project tasks is determined to be completed only upon expiration of said inherent time delay associated with each one of said tasks.

17. The game as defined in claim 1 wherein selected ones of said project tasks comprise prerequisite ones of said tasks, so that initiation of said selected ones of said tasks prior to completion of said prerequisite tasks provides a penalty.

18. The game as defined in claim 17 wherein said penalty comprises additional time delay to complete said selected ones of said tasks.

19. The game as defined in claim 17 wherein said penalty comprises expenditure of additional amounts of said project funds.

20. The game as defined in claim 1 further comprising a play area for a one of said players representing a project manager, said project manager play area including a task scheduling area.

21. The game as defined in claim 20 further comprising task in progress areas in a selected portion of said play area wherein said workers track progress of tasks assigned thereto by said project manager.

22. The game as defined in claim 1 wherein each said worker assigned to one of said project tasks has a predetermined amount of said project finds expended therefor during each one of a plurality of project time periods.

23. The game as defined in claim 1 wherein said risk is allocated to individual ones of said project tasks, each said risk allocated task having a predetermined cost of at least one of said project funds and said work effort to mitigate said risk, each said risk allocated to said individual ones of said tasks having first ones of said consequences incurred on occurrence of a first probabilistic event when said players elect to mitigate said risk, and second ones of said consequences incurred on occurrence of a second probabilistic event when said players elect not to mitigate said risk.

24. The game as defined in claim 1 wherein said risk is aggregately allocated to said project, said aggregate allocation comprising provision of an initial number of risk counters, said risk counters decremented by a predetermined amount on mitigation election by said players, said mitigation election comprising at least one of expenditure of project funds and expenditure of additional work effort, a probability of said probabilistic event occurring and consequences of occurrence of said event related to a number of said counters extant at selected times during said game.

25. A game for teaching project management skills, comprising:

play spaces for players representing project generalists and project specialists each comprising an area to track progress of project tasks, said project tasks part of a predetermined set of tasks which when completed constitute completion of a game project;

a play space for a player representing a project manager, said project manager play space comprising a task scheduling area indicators for amounts of work effort for workers assigned to said project tasks by said players, said work effort indicators incremented by predetermined amount per worker during each game project time period, indicators for time delay for completing said project tasks, indicators for task errors, indicators for tracking said project tasks on said play spaces, and representors for project funds;

first information indicators for each of said project tasks, each said first indicator stating a minimum task completion time, a total amount of said work effort to complete each said task, project funds costs associated with each said task, and an inherent delay time for each said task, said inherent delay time decremented by a predetermined amount for each said game project time period;

second information indicators for identification and mitigation of a risk associated with selected ones of said project tasks, each said second indicator stating at least one of a work effort amount and a project finds cost for identifying and mitigating said risk, each said second indicator stating first and second consequences comprising selected ones of expenditure of additional project funds, accumulation of additional task errors, expenditure of additional work effort and additional time delay to complete said task, said risk incurring said first consequences upon occurrence of a first probabilistic event when said risk is mitigated by said specialists and said generalists, said risk incurring said second consequences upon occurrence of a second probabilistic event when said risk is not mitigated by said specialists and generalists, occurrence of said first and second probabilistic events determined by a random event generator;

indicators for a value of said project, said value indicators decremented from an initial number of said value indicators by a predetermined amount corresponding to a number of said error indicators accumulated;

indicators for stakeholder support, said stakeholder support indicators incremented by a predetermined amount when said project manager meets with stakeholders, consuming a predetermined portion of a per project time period work effort allotted to said project manager, said stakeholder support indicators decremented by a predetermined amount for each project time period, said support indicators decremented by a predetermined amount when said project manager elects to reject a change in scope to said project proposed by said stakeholders, said change in scope comprising selected ones of additional project funds costs, work effort amounts to complete selected ones of said project tasks and additional ones of said tasks to complete said project beyond the tasks in said predetermined set, said change in scope determined when said project manager meets with said stakeholders and wherein said scope change increments said value indicators of said project upon implementation by said project manager, said stakeholder support indicators decremented by a predetermined amount related to an amount of additional funds beyond a preselected budget of said project funds required to complete said project, said additional funds requested by said project manager from said stakeholders upon meeting therewith;

indicators for communications overhead, said communications overhead indicators incremented by an amount corresponding to a number of said progress tasks which are in progress during any one game project time period, said overhead indicators decremented by a predetermined amount when said generalists or said specialists elect that workers assigned to different ones of said project tasks use a portion of a per project time period allotment of said work effort shall meet with each other, said overhead indicators converted by a predetermined formula to a number of said errors at selected times during said game; and product understanding indicators each stating changes in a scope of said game project selected from the group consisting of task work effort amount, project funds amount, and a change in a total value of said project, said product understanding indicators obtained by said generalists and specialists upon completion of one of said project tasks, said product understanding indicators also obtained by said specialists and said generalists upon electing to mitigate one of said risks, said product understanding indicators also obtained by said project manager and communicated to said specialists and generalists from project stakeholder input upon said project manager meeting with said stakeholders.

26. The game as defined in claim 25 wherein said workers produce an amount of said work effort for each said project time period corresponding to a number of said project time periods each said worker is assigned to a particular one of said tasks.

27. The game as defined in claim 25 further comprising overtime work effort producible by selected ones of said workers upon expenditure of preselected amounts of said project finds by said specialists and generalists.

28. The game as defined in claim 25 wherein each one of said project tasks is determined to be completed only upon expiration of said inherent time delay associated with each one of said tasks.

29. The game as defined in claim 25 wherein selected ones of said project tasks comprise prerequisite ones of said tasks, so that initiation of said selected ones of said tasks prior to completion of said prerequisite tasks provides a penalty.

30. The game as defined in claim 29 wherein said penalty comprises additional time delay to complete said selected ones of said tasks.

31. The game as defined in claim 29 wherein said penalty comprises expenditure of additional amounts of said project funds.

32. he game as defined in claim 29 wherein said penalty comprises accumulation of additional ones of said error indicators.

* * * * *